US006107626A

United States Patent [19]

Wang et al.

[11] Patent Number: 6,107,626

[45] Date of Patent: Aug. 22, 2000

[54] DEVICE AND METHOD FOR FORMING IONS

[75] Inventors: Houle Wang; Murray Hackett, both of Seattle, Wash.

[73] Assignee: The University of Washington, Seattle, Wash.

[21] Appl. No.: 09/247,138

[22] Filed: Feb. 9, 1999

Related U.S. Application Data

[63] Continuation-in-part of application No. 08/950,124, Oct. 14, 1997, Pat. No. 5,869,832, and a continuation-in-part of application No. 60/079,000, Mar. 23, 1998.

[51] Int. Cl.[7] ..... H01J 49/26

[52] U.S. Cl. ..... 250/288; 250/423 R

[58] Field of Search ..... 2540/288, 288 A, 2540/423 R

[56] References Cited

U.S. PATENT DOCUMENTS

| | | | |
|---|---|---|---|
| 4,531,056 | 7/1985 | Labowsky et al. . | |
| 4,542,293 | 9/1985 | Fenn et al. . | |
| 4,664,315 | 5/1987 | Parmentar et al. . | |
| 4,849,675 | 7/1989 | Müller . | |
| 5,130,538 | 7/1992 | Fenn et al. . | |
| 5,240,186 | 8/1993 | Dobbins et al. . | |
| 5,543,618 | 8/1996 | D'Silva . | |
| 5,581,080 | 12/1996 | Fenn et al. . | |
| 5,869,832 | 2/1999 | Wang et al. | 250/288 |

OTHER PUBLICATIONS

Banks, J.F., et al., "Electrospray Ionization Mass Spectrometry," *Methods in Enzymology*, vol. 270, 1996, pp. 486–519.

Beavis, R.C., et al., "Matrix–Assisted Laser Desorption Ionization Mass–Spectrometry of Proteins," *Methods in Enzymology,* vol. 270, 1996, pp. 519–551.

Edmonds, C.G., et al., "Electrospray Ionization Mass Spectrometry," *Methods in Enzymology*, vol. 193, 1990, pp. 412–431.

Kelly, A.J., "On the Statistical, Quantum and Practical Mechanics of Electrostatic Atomization," *J. Aerosol. Sci.*, vol. 25, No. 6, 1994, pp. 1159–1177.

Kim, K., et al., "Generation of Charged Drops of Insulating Liquids by Electrostatic Spraying," *Journal of Applied Physics*, vol. 47, No. 5, May 1976, pp. 1964–1969.

Neubauer, R.L., et al., "Supplement to 'Production of Monodisperse Liquid Particles by Electrical Atomization'," *J. Colloid Sci.*, (Letters to the Editors), vol. 8, 1953, pp. 551–552.

Trempst, Paul, et al., "MALDI–TOF Mass Spectrometry in the Protein Biochemistry lab: From Characterization of Cell Cycle Regulators to the Quest for Novel Antibiotics," Mass Spectrometry in the Biological Sciences, A.L. Burlingame and S.A. Carr, Eds., Humana Press, Totowa, NJ, 1996, pp. 105–132.

Vékey, Károly, "Multiply Charged Ions," *Mass Spectrometry Reviews*, vol. 14, 1995, pp. 195–225.

Vonnegut, B., et al., "Production of Monodisperse Liquid Particles by Electrical Atomization," *J. Colloid Sci.*, vol. 7, 1952, pp. 616–622.

*Primary Examiner*—Kiet T. Nguyen

*Attorney, Agent, or Firm*—Christensen O'Connor Johnson & Kindness PLLC

[57] ABSTRACT

A device and method for forming ions by inductive ionization is disclosed. The device is an ion source that includes a capacitor having a pair of electrodes separated by a dielectric material. The method of the invention uses the capacitor-based ion source to form positive and negative ions including multiply-charged ions.

20 Claims, 32 Drawing Sheets

AVERAGE LIQUID CHARGE DENSITY

CYLINDRICAL CAPACITOR: $$\sigma_{av} = \frac{2\varepsilon_0\varepsilon_r V}{(d_1^2 - d_3^2)\ln(d_2/d_1)}$$

$d_1$ : TUBING I.D.
$d_2$ : TUBING O.D.
$d_3$ : WIRE O.D.

PARALLEL PLATE CAPACITOR: $$\sigma_{av} = \frac{\varepsilon_0\varepsilon_r V}{d_1 d_2}$$

$d_1$ : DEPTH OF DIELECTRIC LAYER

MAXIMUM ALLOWED: $$\sigma_{MAX} = \varepsilon_0 X \frac{\varepsilon_r X[\text{DIELECTRIC STRENGTH}]}{d_2}$$

$d_2$ : DEPTH OF LIQUID LAYER $\varepsilon_0 = 8.85 \times 10^{-12}$ FARAD/METER $\varepsilon_r$: DIELECTRIC CONSTANT

V: APPLIED VOLTAGE

Fig. 18

DIELECTRIC PROPERTIES

| MATERIALS | DIELECTRIC CONSTANT ($\varepsilon r$) | DIELECTRIC STRENGTH (Sr) | $\varepsilon r$ X Sr |
|---|---|---|---|
| VACUUM | 1 | | |
| AIR | 1.0006 | | |
| $H_2O$ | 81 | | |
| QUARTZ | 5 | $3X10^7$ (V/M) | $1.5X10^8$ |
| FUSED-SILICA | 3.7 | $3X10^7$ (V/M) | $1.1X10^8$ |
| $BaTiO_3$ | 1000 - 8000 | $>10^6$ (V/M) | $10^9$ - $10^{10}$ |

Fig. 19

| SAMPLES | SIGNAL IMPROVEMENT | |
|---|---|---|
| | FROM LIQUID JUNCTION (A/B) | FROM SS NEEDLE (A/C) |
| UBIQUITIN (+) | 1 | 0.43 |
| UBIQUITIN (-) | 0.74 | 2.3 |
| INSULIN-A (-) | 6.6 | 6.9 |
| DNA (-) | 10 | X |
| PROPRANOLOL | 0.85 | 3 |
| TFP | 2 | 15 |
| DIP | 3.1 | 1.3 |
| TFPoxaz | 0.86 | 5.7 |
| OMeTFP | 2.8 | X |
| OMe TFAim | 8.6 | X |

Fig. 24

ADVANTAGES OF THE PARALLEL PLATE

-ELIMINATION OF CENTRAL ELECTRODE
-CLEAN, SIMPLE "ION FORMING FLOW CELL"
-ALLOWS HIGHER CHARGE DENSITIES
-SUCCESS IS DEPENDENT ON CHOICE OF MATERIAL FOR DIELECTRIC LAYER

Fig. 25

DEVICE AND METHOD FOR FORMING IONS

CROSS-REFERENCE TO RELATED APPLICATIONS

This application is a continuation-in-part of U.S. patent application Ser. No. 08/950,124, filed Oct. 14, 1997, issued as U.S. Pat. No. 5,869,832 on Feb. 9, 1999; and a continuation-in-part of copending U.S. patent application Ser. No. 60/079,000, filed Mar. 23, 1998, the benefit of the filing dates of which is hereby claimed under 35 U.S.C. §§ 120 and 119, respectively. Each of the above-identified applications is expressly incorporated herein by reference.

FIELD OF THE INVENTION

The present invention relates generally to a device and method for forming ions from neutral molecules and, more particularly, to an ion source that forms ions by inductive ionization.

BACKGROUND OF THE INVENTION

Mass spectrometry relates to the determination of the molecular weights of individual molecules by their conversion into ions in vacuo and then subjecting the ions to electric and/or magnetic fields to determine their mass. Ion formation is a prerequisite to the determination of a molecule's molecular weight by mass spectrometry.

Classical ionization methods involve gas phase interactions of the molecule to be ionized with electrons, as in electron impact ionization (EI), photons as in photo ionization (PI), and other ions as in chemical ionization (CI). These ionization methods result in the formation of ions from the neutral molecule by a variety of mechanisms, including the removal from or addition of an electron or a positively charged entity (e.g., a proton) to the molecule. While these classical ionization methods work well for relatively low molecular weight molecules that can be vaporized in vacuo, the extension of these methods to the analysis of large polar molecules, including large organic molecules, such as biopolymers, suffers from the difficulty associated with transforming these molecules into ions. Generally, large polar molecules cannot be vaporized without extensive decomposition.

The deficiencies of classical ionization methods for determining the molecular weight of biologically important molecules have resulted in the development of additional ionization methods directed to producing intact ions from molecules of increasing size. Several of these methods are based on the rapid deposition of energy to a surface upon which the molecule to be analyzed has been deposited. Rapid heating methods include plasma desorption (PD) and secondary ionization mass spectrometry (SIMS), also referred to as fast ion bombardment (FIB), in which the molecule deposited upon a surface is bombarded by ions (e.g., cesium ions) accelerated to energies in the tens of kilovolts. Fast atom bombardment (FAB), in which accelerated ions are neutralized prior to striking the surface, and laser desorption (LD), which involves the use of high energy photons to vaporize the molecule, are also included among these high energy techniques. These techniques have successfully produced intact ions from relatively large bioorganic compounds having molecular weights up to about 30,000 Daltons.

Matrix-assisted laser desorption/ionization-mass spectrometry (MALDI-MS) is a currently popular laser desorption method that has been refined to be particularly useful for mass analysis of high molecular weight biological molecules, such as peptides and proteins. In the method, a protein sample embedded in a light-absorbing matrix, made from a strongly ultraviolet or infrared light absorbing material, is irradiated by intense, short-duration pulses of laser light. The laser light results in the ablation of bulk portions of the protein-containing matrix and the formation of gas phase intact protein ions, the molecular masses of which can then be determined by mass analysis.

Advantages of the MALDI-MS method relate to the fact that biological samples can be examined without extensive purification, in the presence of other proteins, and can include common biochemical additives that do not interfere with the method; most classes of proteins can be examined provided that the protein can be dissolved in appropriate solvents; the total amount of protein required for analysis is in the range of from about 1–10 pmol; and perhaps most significantly, proteins having masses ranging to greater than 100 kDa can be analyzed. Typically, this ionization technique employs a time-of-flight (TOF) mass analyzer, which determines ion mass as a function of the time required for the ion to travel to the analyzer's detector. Thus, unlike other conventional mass analyzers, TOF mass analyzers do not have an upper nominal mass detection limit and are therefore particularly useful in determining the mass of high molecular weight ions.

The MALDI method is not without its limitations. Sample preparation is crucial to matrix-assisted laser desorption ion formation. The surroundings of the protein to be analyzed (i.e., the matrix) must be fashioned so that an intense light pulse can transfer the intact molecule into the gas phase. The matrix is generally a crystal into which the protein is incorporated. However, few compounds can form crystals that incorporate proteins, absorb light energy, and eject and ionize the protein intact. Furthermore, the formation of the protein-containing matrix is not a trivial process that reliably provides useful mass spectra. Although several matrix compounds are widely used, the selection of a matrix for a particular protein is empirical.

In contrast to mass spectrometric techniques that permit the continuous acquisition of mass spectral data from separation devices (e.g., chromatographs) that introduce sample to the ion source, MALDI is a "batch" method requiring substantial sample preparation for each analysis performed. Subtle variations of experimental parameters, for example, the matrix, matrix solvent, laser power, number of laser shots, presence of calibrant, and analyte-to-matrix ratio can cause dramatic changes in the outcome of the analysis. Thus, despite its qualitative analytical benefits, the method does not lend itself to quantitative mass analysis. MALDI-MS of proteins has been recently reviewed by Beavis and Chait in *Methods in Enzymology*, Vol. 270, 1996, pp. 519–551.

Other desorption ionization techniques employ strong electrostatic fields to desorb ions. The methods include thermospray (TS), atmospheric pressure ion evaporation (APIE), atmospheric pressure chemical ionization (APCI), and electrospray (ES) ionization, and generally involve ion desorption from small charged droplets of solution into a bath gas, which is subsequently admitted into the vacuum system of a mass analyzer. Of these techniques, electrospray has evolved into a powerful and widely practiced tool for the analysis of high molecular weight biological molecules. The success of ES in the analysis of biomolecules lies in the method's ability to extract fragile chemical species intact from solution, ionize them, and transfer them to the gas phase for mass analysis. A unique characteristic of the ES ion source is the ability to form multiply-charged ions, which facilitates the analysis of extremely high molecular weight molecules with mass analyzers having relatively low nominal upper mass limits. Electrospray ionization methods have been extensively reviewed. See, for example, reviews by Banks, Jr. and Whitehouse in *Methods in Enzymology*, Vol. 270, 1996, pp. 486–519; and Edmonds and Smith in *Methods in Enzymology*, Vol. 270, 1990, pp. 412–431.

In an ES ion source, a liquid sample is introduced through a small bore tube that is maintained as several kilovolts at or near atmospheric pressure into a chamber containing a bath gas. A strong electrostatic field at the tube's tip charges the surface of the emerging liquid generating coulomb forces sufficient to overcome the liquid's surface tension and to disperse the liquid into a fine spray of charged droplets.

In the ES ionization technique, an external electric field is employed for purposes of both the creation of a spray of fine droplets and for the formation of gas phase ions. The success of the ES ionization method is highly dependent upon the electrostatic field at the tip of the tube as well as other parameters. For example, if the field at the tip is too high, or the pressure of the bath gas too low, a corona discharge will occur at the tip and substantially decrease the effectiveness of the nebulization.

Despite the advances in ion formation achieved by ES ionization methods, the ES technique is not without limitation. A common problem encountered with low flow rate liquid chromatography/mass spectrometric (LC/MS) or infusion type atmospheric pressure ionization (API) inlet designs is unstable operation in negative ion mode. The problem is especially true for analyzing samples in aqueous solution. The problem is manifested in the mass spectra with the appearance of $[H_2O]_n$ peaks and other noncovalent adducts. These artifacts are symptomatic of corona discharge, a common occurrence at nanoliter flow rates, where the more obvious indications of discharge seen at higher flows, such as excessively high electrospray current and disruption of the normal baseline, are often missing. Accordingly, there exists a need for an ionization method that affords the advantages associated with ES ionization, permits negative ion analysis free from adduct formation, and further provides stable ion currents with nanoliter flow rates.

Optimization of negative ion ES ionization, including ion current stability, for biological samples in aqueous solutions is often problematic. While the common practice of using oxygen or sulfur hexafluoride as electron scavengers at the spray tip is known to inhibit corona discharge, discharge problems often remain. Other sources of ion beam instability that are not affected by the presence of scavenger gas, also impact operation in negative ion mode. While efforts to optimize ES ionization using small interior diameter stainless steel capillaries worked extremely well for positive ion formation and detection, such efforts were less successful for negative ion mode. The result suggests that stainless steel has problems with signal stability at low flows with negative ions, especially in aqueous solutions with less than 20% or so organic solvent content.

In addition, ES negative ion experiments with hydrophobic glycolipids (e.g., lipid A) demonstrated that detection limits for the glycolipids, dissolved in chloroform/methanol solution where adduction problems are less severe due to the electron scavenging properties of chloroform and the relatively lower electrospray voltage required to produce useful mass spectra, were still poor compared to those routinely achieved with many positive ion protein and peptide applications. Flow rates below about 500 nL/min are also a problem with ES ion sources. Furthermore, clogging problems with small orifice (about 5 $\mu$m inner diameter) nanospray tips are more severe than for peptide samples. However, because fused silica, a commonly used alternative to stainless steel capillaries, is a poor conductor of electricity, simply switching back to doing ES ionization with small inner diameter fused silica capillary tubes is not an attractive option. Accordingly, a need exists for an improved, highly sensitive method of forming negative ions using low sample flow rates that allow the greatest possible signal-to-noise (S/N) ratio for a given concentration, and maximizes resistance to capillary clogging during nanoliter scale infusion for the analysis of trace quantities of bacterial glycolipids.

As noted above, API methods that employ electrospray and atmospheric pressure chemical ionization sources have found widespread application in biology and chemistry. These devices allow gas phase ions to be formed from highly involatile and sensitive, delicate molecules. In standard ES ionization methods, charging, ionization and solvent evaporation all occur in or near a very small region commonly referred to as the Taylor cone. In order to properly form the Taylor cone and effectively perform ES ionization, flow rate, voltage, pressure, temperature, and solvent properties all have to be optimized over a relatively narrow range. As a result, ES ionization methods typically have a relatively limited range of applications. Accordingly, there exists a need for ionization methods and devices that overcome the deficiencies associated with standard ES ionization methods. More specifically, a need exists for methods and devices in which solution charging and spray formation can be independently optimized. A need also exists for ionization methods and devices having no externally applied high voltage and no strong electric field at the spray tip to avoid the problems associated with corona discharge. The present invention seeks to fulfill these needs and provides further related advantages.

SUMMARY OF THE INVENTION

The present invention provides a device and method for forming ions. Positive and negative ions, including multiply-charged ions, are readily formed by the device and method of this invention. The invention is particularly useful for forming ions from biological molecules such as peptides, proteins, and oligonucleotides.

The device is an ion source that includes a capacitor having a pair of electrodes separated by a dielectric material. In one preferred embodiment, the ion source includes a cylindrical capacitor having a central electrode surrounded by a cylindrical electrode, with the cylindrical electrode separated from the central electrode by a dielectric material. In another preferred embodiment, the ion source includes a capacitor having a parallel plate configuration.

The present invention also provides a method for forming ions using a capacitor-based ion source. In the method, a liquid sample is introduced into the ion source and a voltage is applied to one electrode resulting in ion formation within the capacitor. Ions thus formed are swept out of the source by liquid flow through to, for example, a mass analyzer for mass determination.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 18 is a table illustrating formulas for calculating average liquid charge density for representative capacitors formed in accordance with the present invention;

FIG. 19 is a table comparing dielectric properties for various materials;

FIG. 24 is a table comparing signal improvements for the cylindrical capacitor ion source of present invention (A), liquid junction ion source (B), and electrospray ion source (C) for various samples; and FIG. 25 is a table summarizing some advantages of the parallel plate ion source formed in accordance with the present invention.

DETAILED DESCRIPTION OF THE PREFERRED EMBODIMENT

Figure 1:
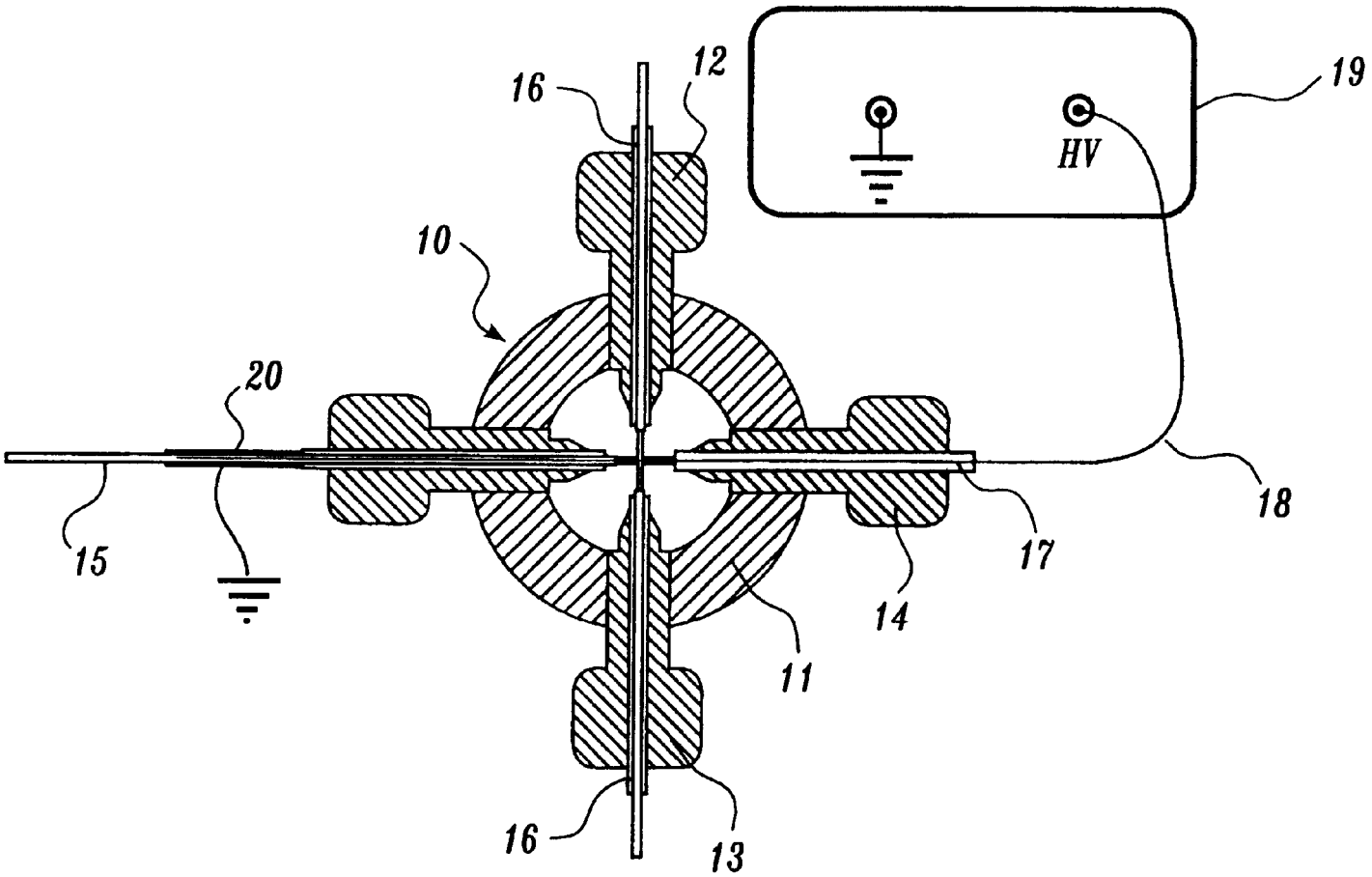
FIG. 1 is a schematic illustration of a representative ion source formed in accordance with the present invention.

The present invention relates to a device and method for forming ions from neutral molecules by inductive ionization. The device of the present invention is an ion source that may, for example, be readily interfaced with a mass spectrometer to provide for mass analysis of liquid samples. The ion source is a current limited device that includes a capacitor, which creates an internal electric field and serves to induce charge to the liquid sample introduced into the ion source. The ion source of this invention can be used to produce positive and negative ions.

As used herein, the term "inductive ionization" refers to a process for producing ions from neutral polyatomic molecules by inductively charging a liquid sample containing these molecules within a capacitor. Generally, the capacitor useful in the present invention includes a pair of electrodes separated by a dielectric material. The capacitor can take the form and configuration of capacitors known in the art.

The following description of the operation of the device of the present invention also illustrates the principles of inductive ionization. A liquid sample containing the neutral polyatomic molecule(s) to be analyzed is introduced into the ion source and the source's capacitor. A direct current voltage applied to the capacitor's electrodes by a power supply results in the capacitor being charged by induction, including the inductive charging of the dielectric material, which ultimately results in ion formation. Ions formed in the ion source's capacitor are then swept out of the capacitor by liquid flow.

The capacitor-based ion source of the present invention generates ions by an electrophoretic process. Unlike many conventional ion sources, the ion source of this invention forms ions in the condensed phase. With capacitor charging, ions are generally formed at or near the surface of the working electrode (i.e., the electrode biased either positive or negative by the applied voltage), which is in contact with a liquid sample introduced into the ion source. Depending on the applied voltage, electrons are either being withdrawn from or donated to the liquid at the working electrode with the overall result being the formation of ions. The applied voltage can be direct current voltage that biases the working electrode either positive or negative. The voltage can also be applied as alternating current.

The ions are formed in the ion source's capacitor by one or more complex and poorly understood processes. The ion forming processes may include (1) direct inductive ionization; (2) ionization resulting from electrochemistry (e.g., redox chemistry) occurring at or near the surface electrode; and (3) ionization occurring by chemical and/or electrochemical processes away from the electrode, for example, in the liquid solution at the dielectric surface. For example, under certain conditions, the working electrode can be simply viewed as an electrode in a solution and having solvated free electrons at its surface. Solvated electrons in solution react to form additional reactive species including nucleophiles and/or bases such as hydroxide ion, which in turn react with, for example, solute species to form ions. Thus, the capacitor of the ion source of this invention can be viewed as providing an "ionization medium" in the condensed phase from which neutral molecules in the liquid sample (i.e., the sample's solute) can be converted into ions. Many of the same processes described above that are believed to occur within the ion source of this invention are also believed to occur at the spray tip of a standard ES ion source. Because these processes occur internally within the capacitor-based ion source of this invention, processes occurring at the device's spray tip are not as important as for standard ES ion sources.

In addition to creating an electric field in the ion source, charging of the capacitor creates a surface charged working electrode and a charge polarized dielectric material. Ions formed at or near the working electrode respond electrophoretically by migration, depending on their charge, to either the electrode surface or the charge polarized surface of the dielectric. Thus, when the capacitor is charged, a stream of charge between the capacitor's electrodes is created in the liquid sample. As described below, the stream of charge and the capacitor's electric field are orthogonal to the liquid flow through the capacitor. The result is charge separation and the creation of ionic double layers at the capacitor's surfaces. For example, when the working electrode is biased positive, negatively charged species migrate to the electrode's surface where they can be neutralized, and positively charged species migrate to the surface of the polarized dielectric where they collect or accumulate. Charge storage results from the accumulation of ions at the dielectric surface.

Ion formation in the capacitor-based ion source of this invention can be a continuous and dynamic process because liquid can be continuously introduced into the ion source. Liquid sample flowed into the capacitor replenishes the supply of species from which the ion source's "ionization medium" and solute ions can be formed. Furthermore, liquid flowed through the ion source provides shear forces sufficient to sweep the charged liquid and ions formed and accumulated in the source out of the capacitor through an exit and into, for example, a mass spectrometer for mass analysis. In contrast to electrospray ionization methods that require strong externally applied electric fields at the spray tip, ions formed in the capacitor-based source of this invention travel out of the capacitor away from the internal electric field through, for example, an exit capillary, to the source's exit that has no externally applied electric field. A spray or beam of charged liquid droplets that include ions formed in the capacitor is created by coloumbic repulsion as the liquid emerges from the source's exit.

The liquid introduced into the capacitor-based ion source provides several functions. First, the liquid provides a medium for solubilizing and introducing into the source neutral polyatomic molecules to be ionized. Second, during ion formation and electrophoresis in the capacitor, the liquid acts as a conductor, albeit a poor conductor because the capacitor-based source is a current limited device. Third, the liquid acts as an insulator/dielectric when sweeping the ions out of the capacitor to the source exit.

Generally, a capacitor includes a pair of electrodes in a parallel configuration separated by a dielectric material. In one preferred embodiment, the device of the present invention includes a concentric cylindrical capacitor having a central electrode surrounded by a cylindrical electrode, the central electrode separated from the cylindrical electrode by a dielectric material. In another preferred embodiment, the device includes a pair of parallel plates (i.e., electrodes) separated by a dielectric material. In this embodiment, ion formation occurs when liquid sample is flowed into the region of the capacitor between the plates.

The dielectric material useful in the ion source of the present invention can include any one of a variety of dielectric materials. A dielectric material can be characterized by its relative permittivity, (i.e., dielectric constant, $\epsilon_r$) and dielectric strength ($S_r$). Preferred dielectric materials have high dielectric constants and dielectric strengths. High capacitance charge density is one advantageous property of the dielectric material useful in the present invention. For a dielectric material, charge density is a function of the product of dielectric constant and dielectric strength (i.e., $\epsilon_r \times S_r$). Accordingly, because the greatest charge densities can be achieved by dielectric materials having high values for $\epsilon_r \times S_r$, preferred dielectric materials have high $\epsilon_r \times S_r$ values. Preferably, the dielectric material has a $\epsilon_r \times S_r$ value greater than about $5 \times 10^8$ and, more preferably greater than about $1 \times 10^9$. FIG. 18 illustrates relationships between dielectric constant, dielectric strength, and charge density, and the charge density relationships for representative cylindrical and parallel plate capacitors formed in accordance with the present invention. The dielectric properties (i.e., dielectric constant, strength, and $\epsilon_r \times S_r$) for some dielectric materials are tabulated in FIG. 19. As indicated in FIG. 19, barium titanate ($BaTiO_3$) has a high dielectric constant and a correspondingly high value for $\epsilon_r \times S_r$. In addition to having high dielectric constant and dielectric strength, preferred dielectric materials useful in the present invention also have glass-like surface properties (e.g., provide relatively smooth and chemically inert surfaces) and are relatively inexpensive and suitable for microfabrication. In addition to fused silica, preferred dielectric materials include, for example, barium titanate and strontium titanate.

Preferred barium titanate dielectric materials include single crystalline barium titanate and glass or fused silica doped with barium titanate. Single crystal material is preferred because of its smooth surface and because the material lacks the porosity of standard amorphous ferroelectric materials commonly used in the industry. Glass and fused silica doped with ferroelectric materials can offer the same advantage. For parallel plate capacitor designs, single crystal barium titanate or related material is preferred.

In a preferred embodiment, the device of the present invention includes a cylindrical capacitor having a central electrode surrounded by a cylindrical electrode and further including, as a dielectric material, a fused silica capillary positioned between the electrodes. As noted above, when a liquid flows through a cylindrical capacitor between the central electrode and the fused silica dielectric material, the liquid can be charged by induction. For positive ion detection, a high positive direct current voltage is applied to the central electrode resulting in ion formation from the liquid and the migration of these ions toward the dielectric surface (i.e., the fused silica dielectric) orthogonal to the direction of liquid flow. When the flow rate of the liquid is sufficiently high, ions will be swept out of the capacitor. However, some fraction of the anions formed will be neutralized at the central electrode leading to a net positive charging of the liquid. The minimum flow rate required to sweep ions from the system is determined by a complex interaction involving the liquid (i.e., its component solvents) employed and the electric double layer formed at the dielectric inner surface. For embodiments of the present invention that include a fused silica dielectric and a platinum central electrode, their surface chemistry will also play a role in the nature and extent of ions exiting the ion source's capacitor. The effect of liquid flow rate on the mass spectra of ions formed by the ion source of this invention interfaced to a mass spectrometer is described in Example 4.

The capacitance C of a cylindrical capacitor can be given as:

$$C = \frac{2\pi\varepsilon_o\varepsilon_r L}{\ln(d_2/d_1)} \tag{1}$$

If the capacitance is multiplied by the applied voltage and divided by the liquid volume contained within the fused silica dielectric, the average charge density a of the liquid induced by an applied voltage V can be approximated:

$$\sigma = \frac{8\varepsilon_o\varepsilon_r V}{(d_1^2 - d_3^2)\ln(d_2/d_1)} \tag{2}$$

where L is the length of the capacitor; $\epsilon_0$ and $\epsilon_r$ are the permittivity of a vacuum and the relative permittivity of the dielectric material, respectively; and $d_1$, $d_2$, and $d_3$ are the fused silica dielectric interior diameter (i.d.), outer cylinder electrode i.d., and the central electrode diameter, respectively. When the charge density reaches a certain value, coloumbic repulsion will overcome noncovalent forces holding the liquid together, and the liquid stream will break apart as it exits the ion source through an exit capillary, for example, a fused silica capillary. The charged particles in the resulting spray can include ions and/or ions surrounded by solvent molecules.

The electric field generated by the charge density σ in a volume v can be calculated by:

$$E = \frac{1}{2\pi\varepsilon_o\varepsilon_r'}\int_v \frac{r}{|r|^3}\sigma dv \tag{3}$$

where $\epsilon_r'$ is the permittivity of the liquid, and r is the space vector. Assuming the charge density a is uniform along the exit capillary, the field at the tip will be approximately $10^6$ to $10^7$ V/m when the voltage applied to the central electrode is 2 kV. This field is approximately the same strength as reported for the field at an electrospray ionization tip. However, the charge density is not uniform and edge effects are expected to increase the charge density at the exit tip to levels higher than the values predicted by Equation (3). In a preferred embodiment, the voltage applied to the central electrode is in the range of from about 1.3 to about 2.2 kV.

In contrast to standard electrospray and conventional ion sources, the ion source of the present invention employs a capacitor for forming ions. The capacitor-based ion source formed in accordance with the present invention also fundamentally differs from conventional electrospray ion sources in several other ways. First, the capacitor-based ion source does not utilize an externally generated high electric field around the spray tip. Rather, the high voltage electrode is located within the capacitor and can be remotely located (e.g., positioned more than 10 cm) from the spray tip and shielded by the grounded outer stainless steel cylindrical electrode. Thus, because there is no high voltage metal electrode exposed in the air and no high externally applied field that would serve as an electron source to trigger the discharge avalanche, the ion source of this invention is not prone to corona discharge. In contrast to electrospray ionization and because the ion source of this invention is a current limited device, at the high operating voltage, the spray tip can even touch the grounded portion of the mass spectrometer without a significant increase in current. Perhaps most importantly, unlike electrospray ionization methods in which spray stability and Taylor cone formation are dependent on the shape of the electric field, solvent properties, temperature, liquid flow rate, and pressure, the ions formed by the capacitor-based ion source of the present invention are ejected by coloumbic repulsion from a highly charged solution with significantly less dependence on these variables. With the ion source of this invention, a stable spray can be formed in free space without a counterelectrode present external to the spray tip. A significant and useful consequence of these characteristics is that optimization of the characteristics of the spray can be performed independently from ion formation for the ion source of the present invention. Electrospray ion sources lack such flexibility in parameter optimization.

A representative ion source formed in accordance with the present invention is schematically illustrated in FIG. 1. Referring to FIG. 1, ion source 10 includes a nonconductive housing 11 having a sample inlet 12, an auxiliary inlet 13, and a power inlet 14. Ion source 10 can also include an exit capillary 15 for directing charged liquid formed in the device to, for example, a mass analyzer. Sample inlet 12 and auxiliary inlet 13 can be fitted with capillaries 16 for introducing liquids to the device. Power inlet 14 can be fitted with an nonconductive sleeve 17 for insulating power supply lead 18 from high voltage power supply 19, which serves as the power source for capacitor 20 shown in greater detail in FIG. 2. In a preferred embodiment, power supply lead 18 is covered with an insulated sleeve up to the point at which the lead enters the capacitor.

Sample inlet 12 serves to introduce a liquid sample into the ion source. The sample inlet can be used to directly infuse a liquid sample to the source by, for example, a syringe pump (not shown). Alternatively, the inlet can be interfaced to a liquid chromatography or a capillary electrophoretic system. Auxiliary inlet 13 is optional and serves to introduce a make-up liquid to the ion source. Generally, a make-up liquid is introduced into the ion source for a variety of reasons including, for example, adjusting the charge storage capacity of the liquid sample in the ion source and for optimizing the ion beam or spray exiting the ion source. Suitable make-up liquids include solvents such as isopropanol, methanol, 2-methoxyethanol, water, and mixtures of these solvents.

Figure 2A:
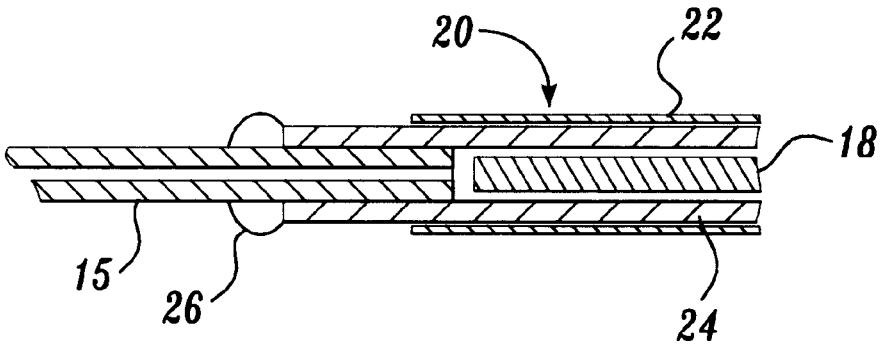
FIG. 2A is a cross-sectional view of a representative cylindrical capacitor ion source formed in accordance with the present invention.

A cross-sectional view of a cylindrical capacitor of a representative ion source of the present invention is shown in FIG. 2A. Referring to FIG. 2, capacitor 20 includes central electrode 18, cylindrical electrode 22, and dielectric material 24. Cylindrical electrode 22 surrounds central electrode 18 in a concentric configuration and dielectric 24 surrounds central electrode 18 and generally forms a dielectric surface interior to cylindrical electrode 22. Depending on the application, device 10 can include exit capillary 15. In one presently preferred embodiment of the invention, capillary 15 is a fused silica capillary having an external diameter less than the interior diameter of dielectric 24 such that capillary 15 can be inserted into dielectric 24. Capillary 15 can be secured to dielectric 24 by any one of a variety of means including, for example, a resinous material such as epoxy resin, represented in FIG. 2A by reference numeral 26. The capacitor's central electrode 18 is generally made from a conductive material that can be biased with either a positive or a negative charge through the application of voltage. In a preferred embodiment, the central electrode is a metal wire and, in a more preferred embodiment, the central electrode is a platinum wire. Generally, the cylindrical electrode 22 is made from a conductive material that is grounded to earth potential. Cylindrical electrode 22 can be made of any one of a variety of materials including, for example, stainless steel and graphite materials such as carbon paste. Electrodes 18 and 22 are separated by a dielectric material 24 such as, for example, a fused silica capillary dielectric material. Generally, the fused silica dielectric is cylindrical and has an outer diameter less than the interior diameter of cylindrical electrode 22 and an interior diameter greater than the diameter of central electrode 18. Dielectric 24 is insertable into cylindrical electrode 22 and has a length at least as great as central electrode 18. The construction and operational characteristics of a representative ion source of this invention are described in Example 1.

Figure 2B:
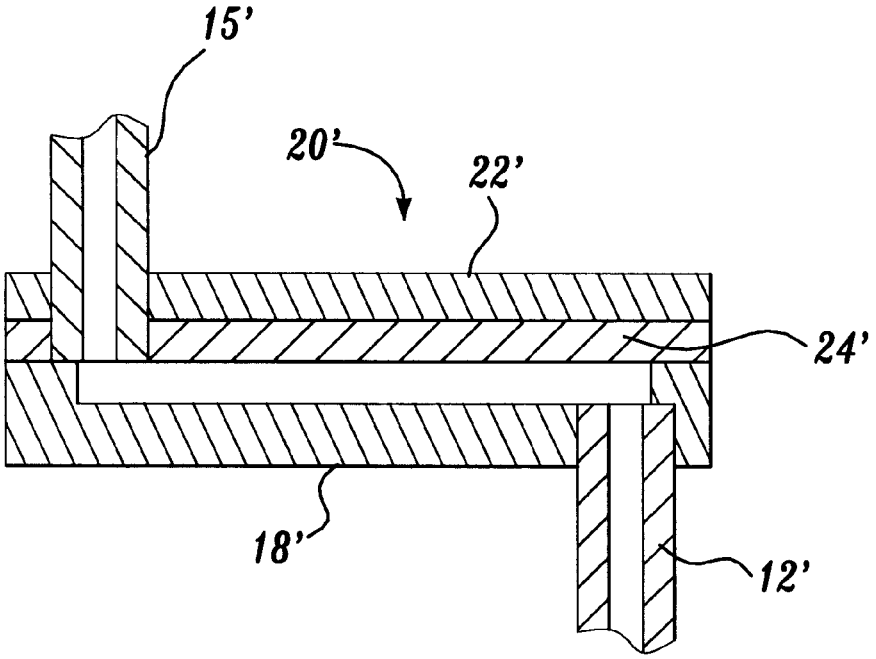
FIG. 2B is a cross-sectional view of a representative parallel plate capacitor ion source formed in accordance with the present invention.

A cross-sectional view of another representative ion source of the present invention having a parallel plate capacitor is shown in FIG. 2B. Referring to FIG. 2B, capacitor 20' includes working electrode 18', ground electrode 22', and dielectric material 24'. Electrodes 18' and 22' have a generally parallel configuration and are separated by dielectric 24'. Dielectric 24' generally covers the interior surface of electrode 22'. In a preferred embodiment, working electrode 18' is gold foil and dielectric material 24' is barium titanate. As shown in FIG. 2B, the ion source includes sample inlet 12' and exit capillary 15'. The relative configuration of inlet 12' and capillary 15' is not particularly critical to the operation and performance of the ion source of the invention. Preferably, inlet 12' and capillary 15' are positioned on opposing ends of the capacitor.

As noted above, when a liquid sample is flowed into the ion source and capacitor 20', the liquid flows between dielectric 24' and electrode 18'. Application of a direct current voltage to electrode 18' inductively charges electrodes 18' and 22', dielectric 24' and the liquid present in capacitor 20', and ultimately results in ion formation as described above. Generally, the charged liquid and ions formed in the capacitor are swept out of the capacitor by the liquid flow into the capacitor by way of the sample inlet and/or the auxiliary inlet. The charged liquid and ions formed in the capacitor are exited through exit capillary 15' and emerge from the capillary as a spray or beam of charged liquid that includes charged liquid droplets and/or ions surrounded by solvent molecules. Exit capillary 15' serves to direct ions formed in the capacitor out of the ion source and to, for example, a mass analyzer.

Figure 20:
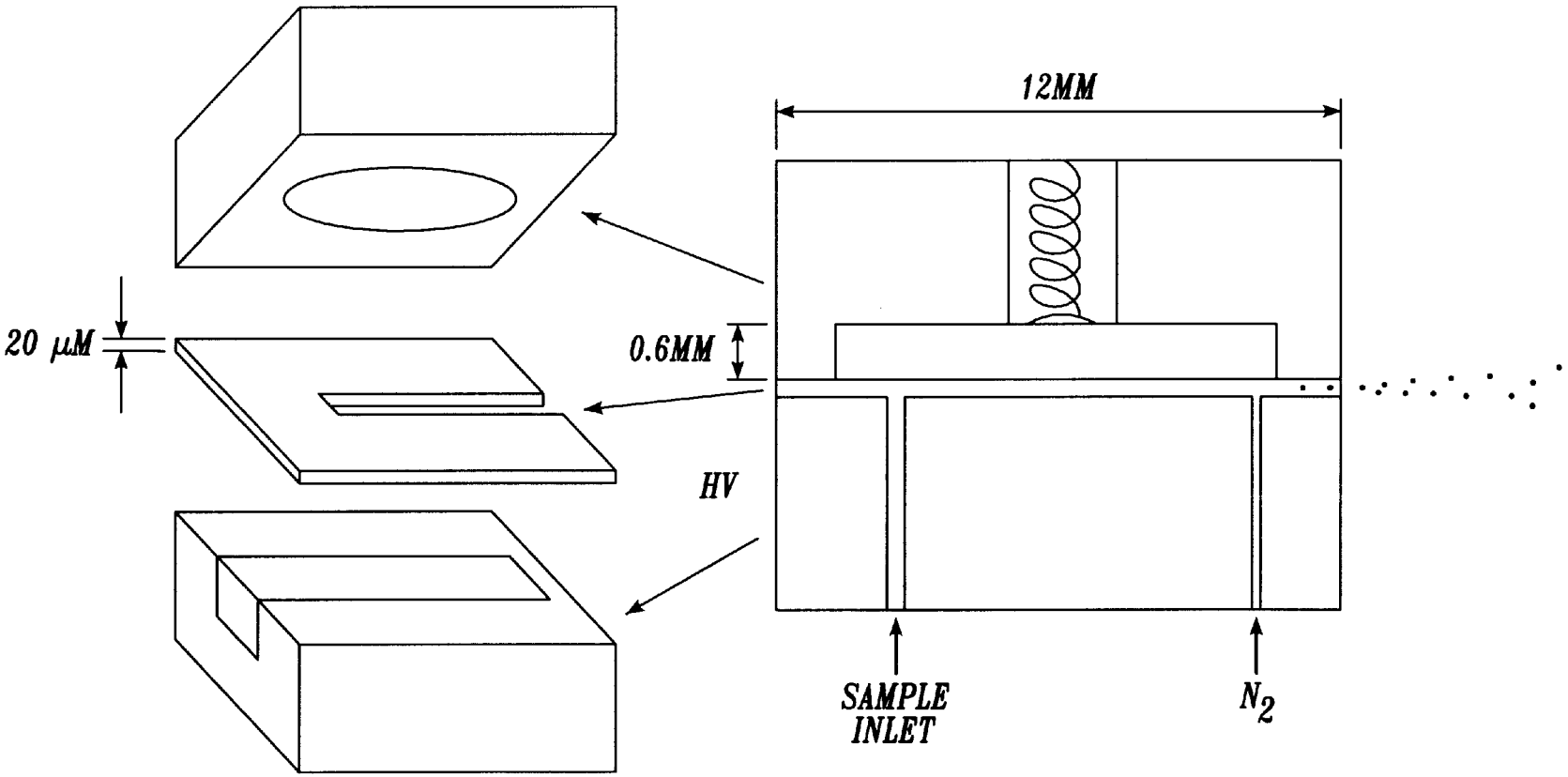
FIG. 20 is a perspective view of a representative parallel plate capacitor flow cell ion source formed in accordance with the present invention.
Figure 21:
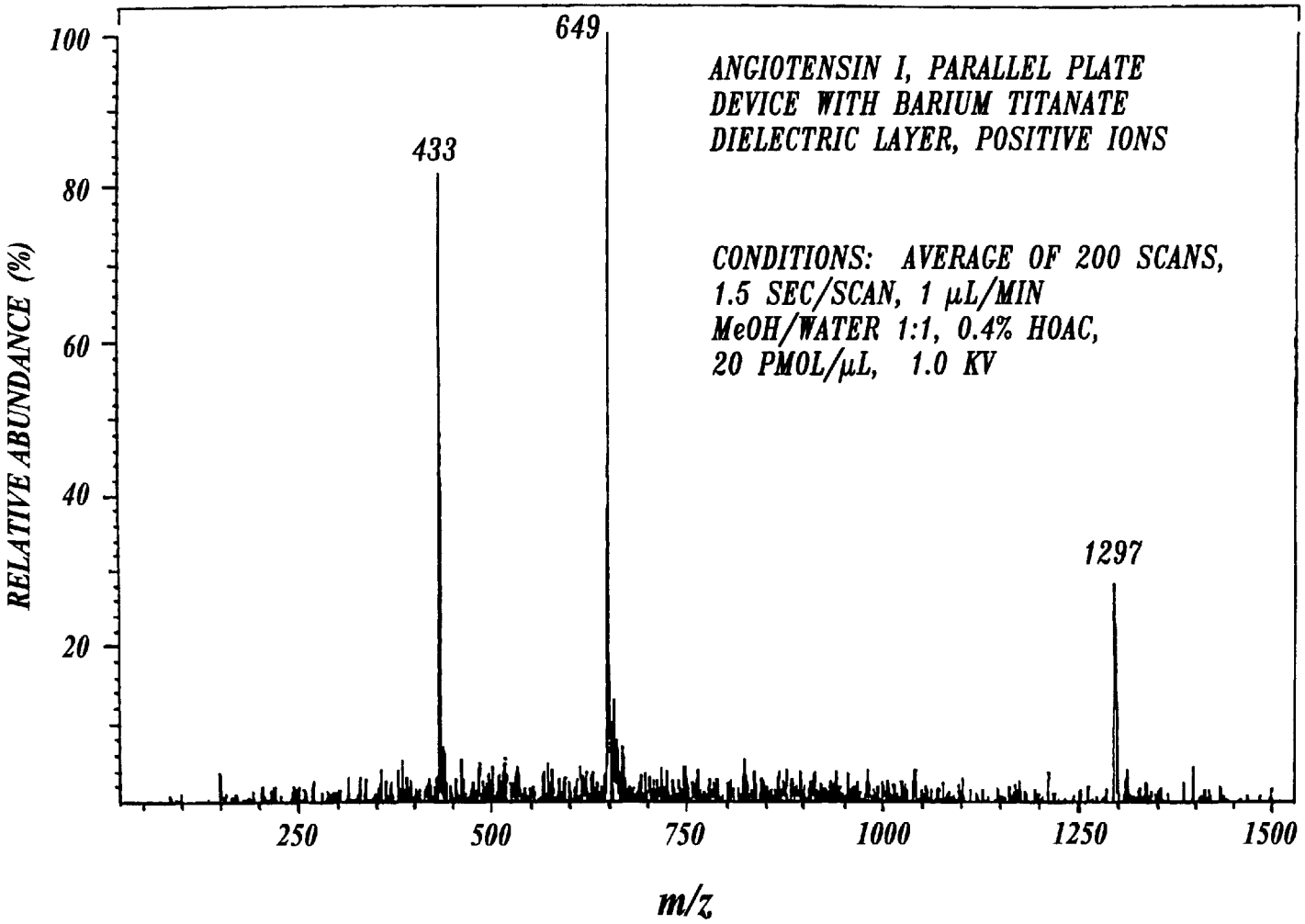
FIG. 21 is a positive ion mass spectrum of angiotensin I obtained from a mass spectrometer interfaced with a representative parallel plate ion source formed in accordance with the present invention with high voltage (1.0 kV) applied to the source's gold electrode (20 pmol/μL solution of angiotensin I was infused into the ion source at a flow rate of 1 μL/min., average of 200 profile mode scans at 1.5 sec./scan)
Figure 22:
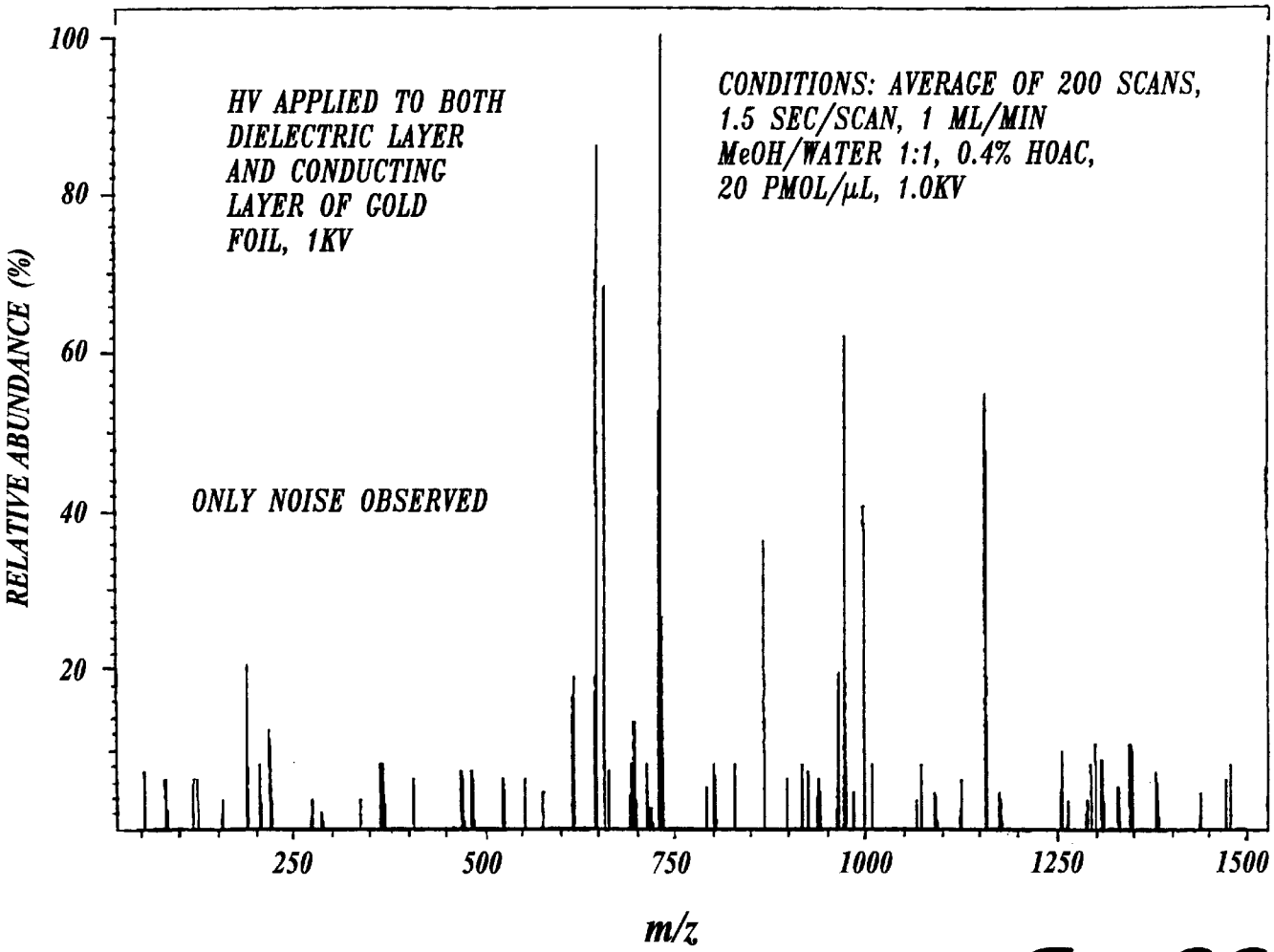
FIG. 22 is a positive ion mass spectrum of angiotensin I obtained from a mass spectrometer interfaced with a representative parallel plate ion source formed in accordance with the present invention with high voltage (1.0 kV) applied to both dielectric layer and gold electrode (20 pmol/μL solution of angiotensin I was infused into the ion source at a flow rate of 1 μL/min., average of 200 profile mode scans at 1.5 sec./scan)

In one preferred embodiment, the parallel plate ion source of the present invention is a flow cell. A representative parallel plate flow cell is illustrated in FIG. 20. FIGS. 21 and 22 are positive ion mass spectra of angiotensin I obtained from a mass spectrometer under various conditions interfaced with a representative parallel plate capacitor ion source formed in accordance with the present invention. Some advantages of the parallel plate capacitor ion source are summarized in FIG. 25.

The voltage applied to the capacitor is limited by the power supply, which is generally a 0–5 kV power supply. Generally, the application of voltage to the capacitor biases the electrode to which the voltage is applied either positive or negative, creates an electric field orthogonal to the electrodes, and polarizes the dielectric material, and, ultimately, forms ions from the liquid sample within the capacitor. The upper limit of the applied voltage is the voltage at which the capacitor's dielectric material undergoes dielectric breakdown. The voltage at which dielectric breakdown occurs is a function of the dielectric material and particularly its size and, more particularly, thickness. For a presently preferred embodiment of this invention, the upper limit of applied voltage is believed to be about 5–6 kV. Preferably, a voltage of about 1–2.5 kV is applied to the capacitor of this invention.

The device of the present invention is an ion source that can be interfaced to a mass analyzer and can therefore be used in the determination of the molecular weight of substances by mass spectrometry. Thus, the device of the present invention can be an ion generating means for a mass spectrometer. The ion source of this invention can be interfaced to a mass spectrometer as generally described in Example 2.

As in conventional electrospray (ES) methods, ions formed by the ion source of this invention generally include multiply-charged ions. For species of large molecular weight, the resulting ions include a large number of charges distributed between a minimum and maximum number. The minimum and maximum number of charges depend on the size and composition of the species. For example, in ES methods, a protein with a molecular weight of about 40,000 Daltons can produce ions having 40 or more charges. The multiplicity of charge reduces the mass/charge (m/z) ratio of the ion and thereby increases the effective mass range of any mass analyzer by a factor equal to the number of charges/ion. Thus, for a species having a molecular weight of 40,000 Daltons and having 40 charges, such a molecule may be readily analyzed by a mass analyzer having a nominal upper mass limit of 1,500 Daltons. The terms "effective" and "nominal" are used herein to characterize the mass capability of an analyzer because, conventionally, mass spectrometry assumes that analyzed ions are singly charged. Consequently, traditional mass analyzers that determine the m/z value for an ion have z=1. Thus, the ion source of this invention can provide useful mass spectra containing peaks corresponding to intact parent molecules and molecular fragments having molecular weights significantly higher than the nominal upper mass limit of the analyzer used to obtain the spectra. In standard ES methods, examples of multiply-charged ions include protein ions having molecular weights in excess of about 250,000 Daltons and containing as many as 200 or more charges, and oligonucleotide ions having molecular weights of about 20,000 Daltons that provide parent ions containing from about 10 to 50 or more negative charges. In contrast to classical ionization methods, which typically produce only singly charged ions and more recently developed ionization techniques that can produce ions having two or three charges, the ion source of the present invention, like ES ion sources, typically can produce large molecular weight parent ions containing a large number of charges.

For liquid samples containing a relatively small number of different molecular species having relatively large molecular weights (e.g., >10 kD) introduced into the ion source of this invention, the resulting ions constitute, for each molecular species, a population in which each member consists of a molecule of that species having n charges. In that population, n takes on all integral values between the minimum and maximum value of n. The minimum and maximum values are determined by the size and the composition of the species and increase as the species' molecular weight increases. The maximum number of charges seems to be such that the mass/charge (m/z) ratio of these ions is generally greater than about 500, and the minimum number of charges is such that the maximum value of m/z is probably under about 3,000. For large molecules, the maximum value of m/z corresponds to values of n that are usually greater than three or four.

The present invention can be used to form ions from a variety of neutral polyatomic molecules including biologically important molecules such as biopolymers including, for example, peptides, polypeptides, proteins, glycoproteins, carbohydrates, and polynucleotides. Because of the relatively mild conditions under which neutral molecules are introduced into the ion source and subjected to during inductive ionization, relatively sensitive and fragile molecules can be converted into ions. While ion fragments can potentially be formed with the ion source of this invention, a substantial population of ions includes parent molecular ions. Thus, the present invention is particularly well suited for the generation of ions from sensitive and fragile molecules that are either ionized with difficulty or impossible to ionize by other conventional ionization methods.

Figure 4A:
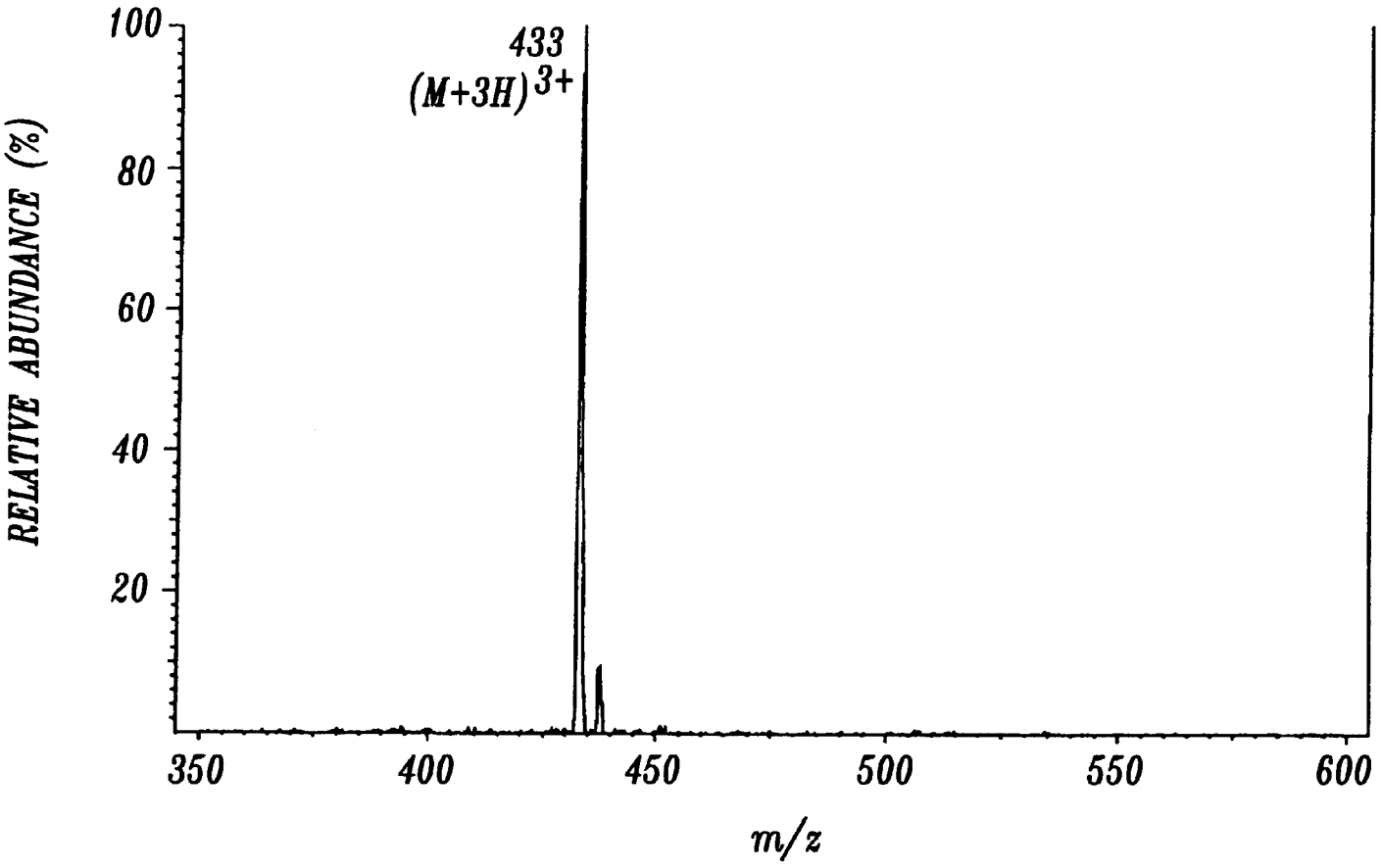
FIG. 4A is a mass spectrum of angiotensin I obtained from a mass spectrometer interfaced with a representative ion source formed in accordance with the present invention in which a 1 pmol/μL solution of angiotensin I was infused into the ion source at a flow rate of 50 μL/min. (average of 50 profile mode scans at 0.5 sec./scan)
Figure 4B:
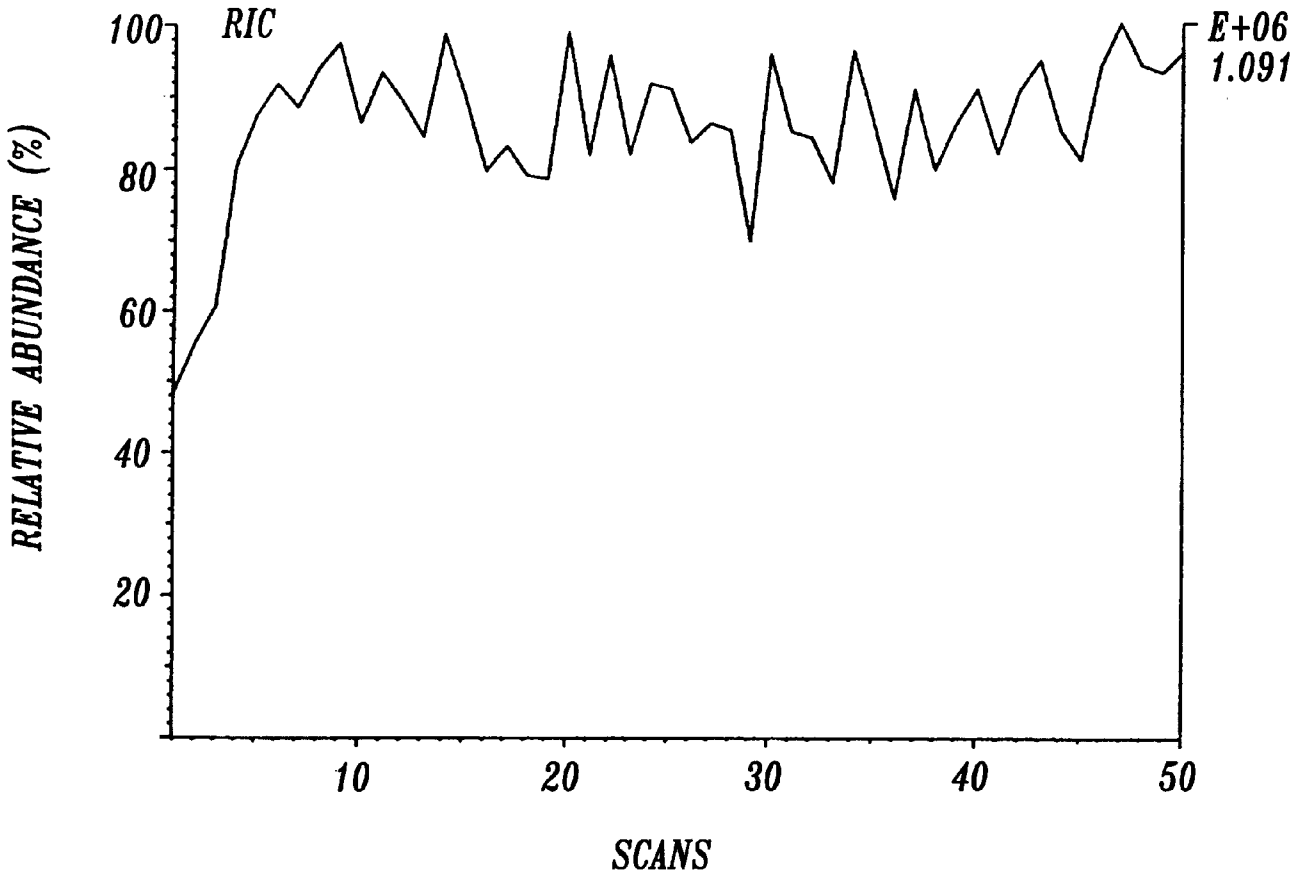
FIG. 4B is a reconstructed ion current plot for the mass spectrum shown in FIG. 4A.
Figure 5D:
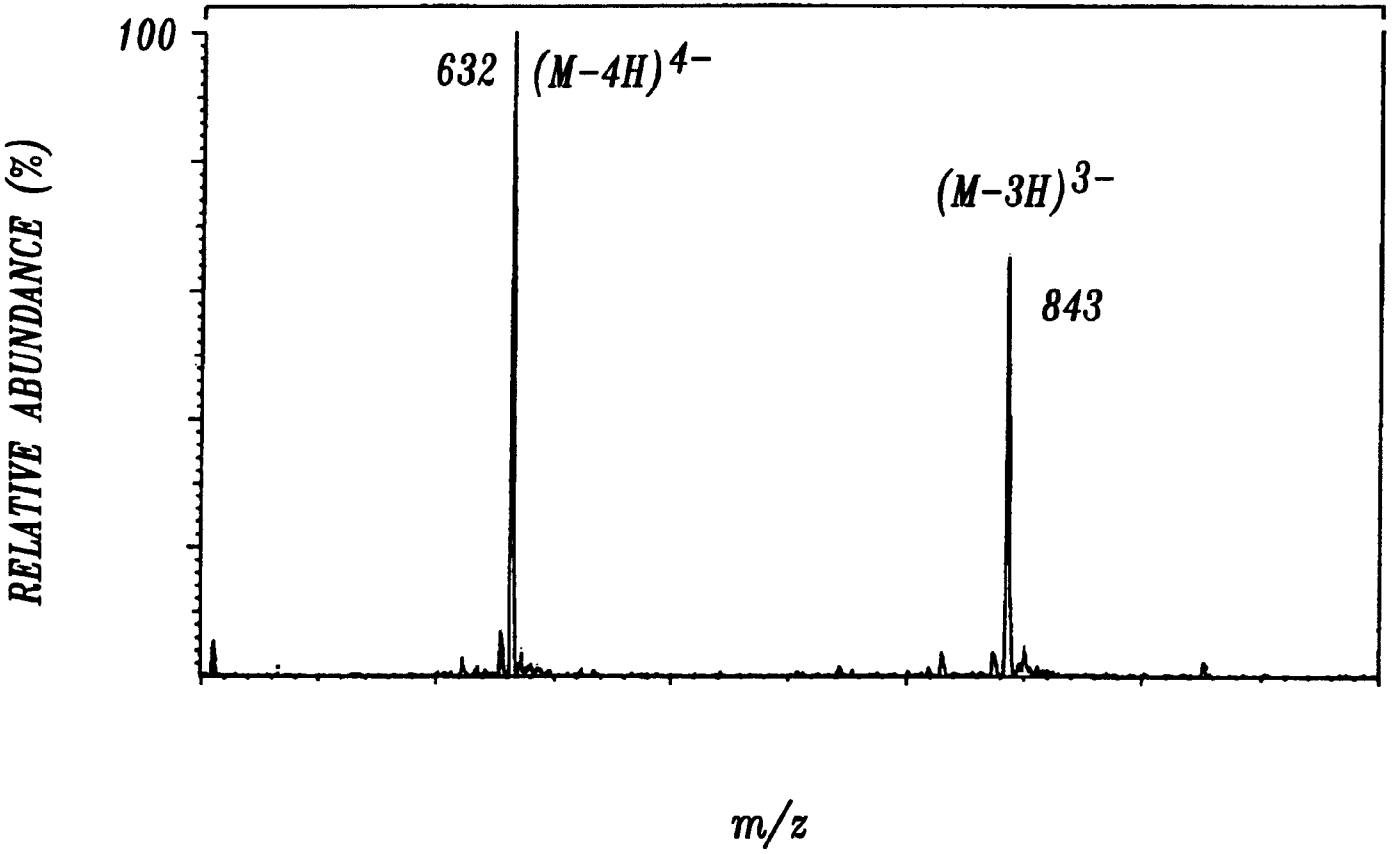
FIG. 5A is a negative ion mass spectrum of insulin α-chain (5 pmol/μL infused at 50 nL/min.) obtained from a mass spectrometer interfaced with a representative ion source formed in accordance with the present invention.
FIG. 5B is a reconstructed ion current plot for the mass spectrum shown in FIG. 5A.
Figure 5B:
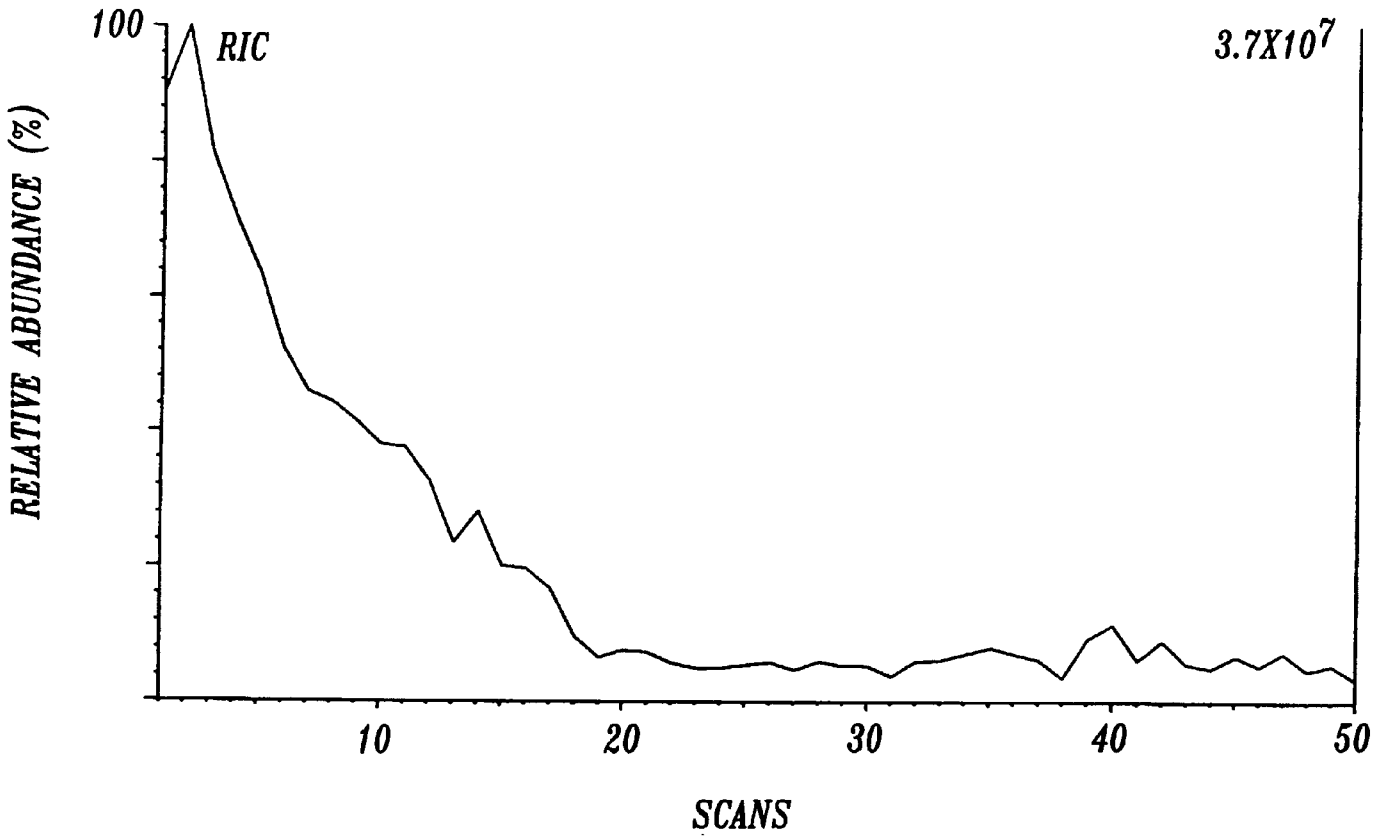
Figure 6A:
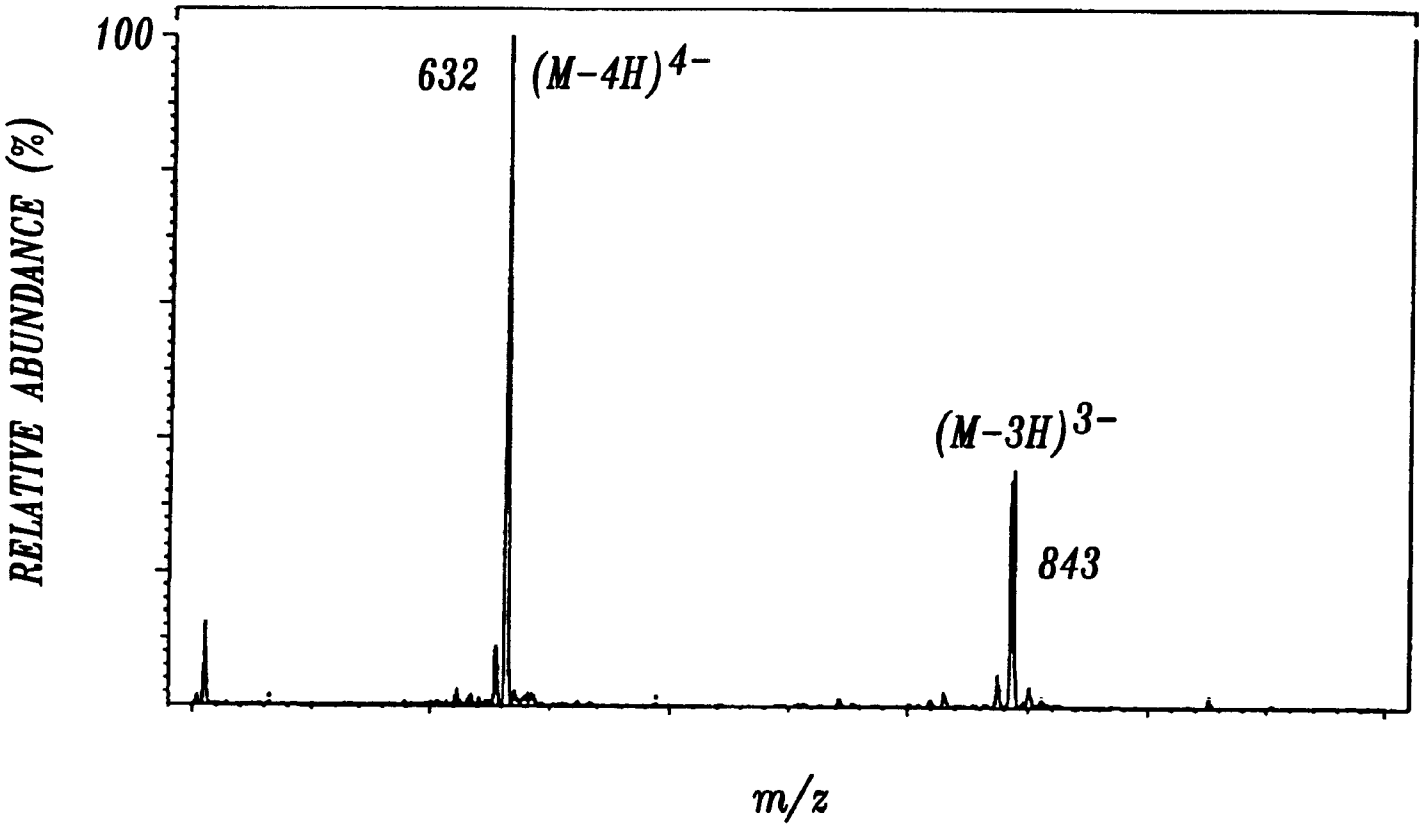
FIG. 6A is a negative ion mass spectrum of insulin α-chain (5 pmol/μL infused at 100 nL/min.) obtained from a mass spectrometer interfaced with a representative ion source formed in accordance with the present invention.
Figure 6B:
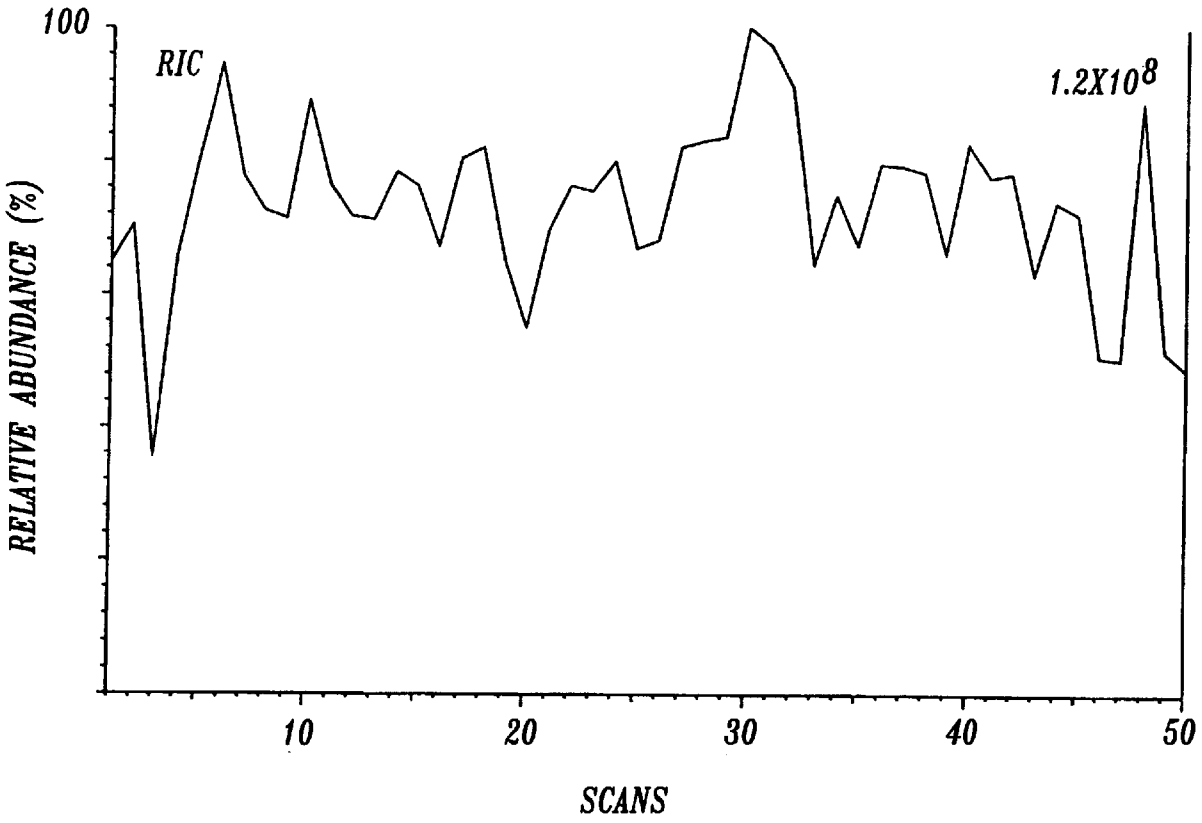
FIG. 6B is a reconstructed ion current plot for the mass spectrum shown in FIG. 6A.
Figure 7A:
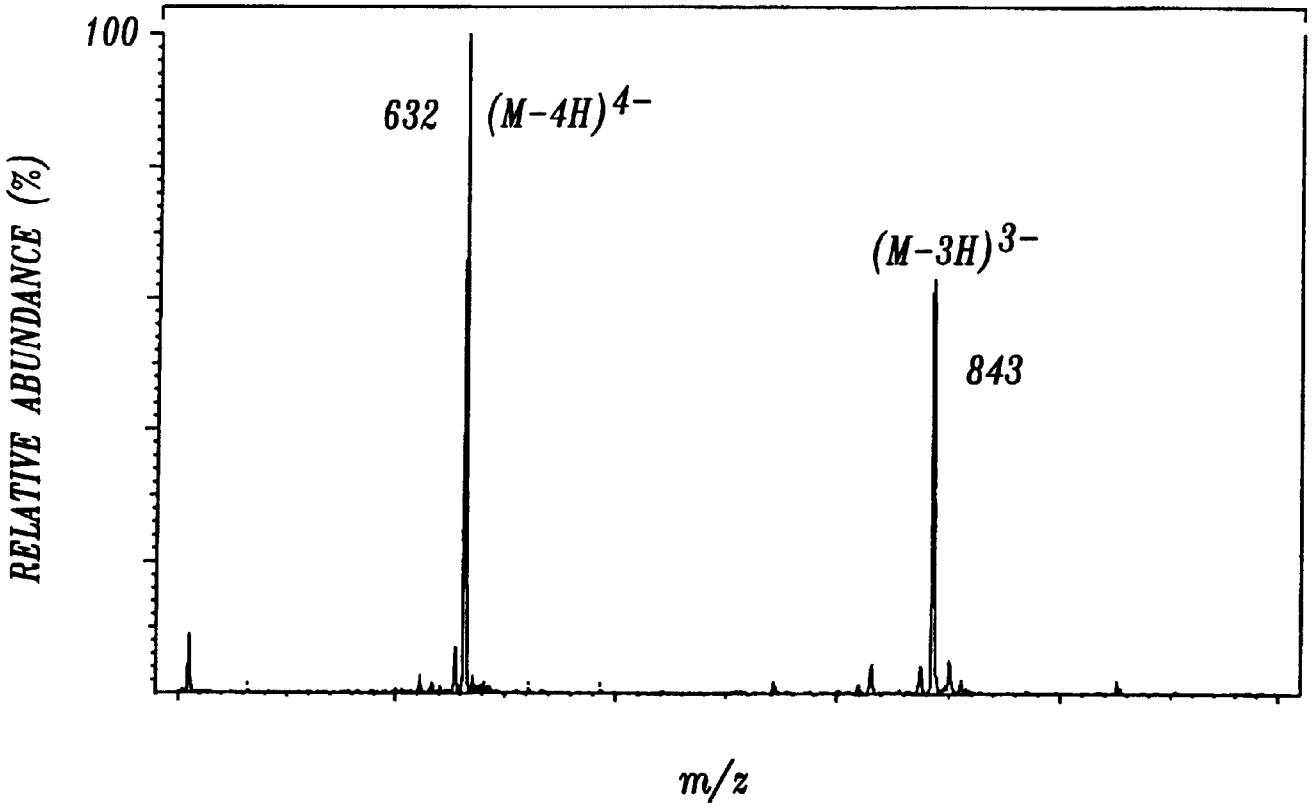
FIG. 7A is a negative ion mass spectrum of insulin α-chain (5 pmol/μL infused at 200 nL/min.) obtained from a mass spectrometer interfaced with a representative ion source formed in accordance with the present invention.
Figure 7B:
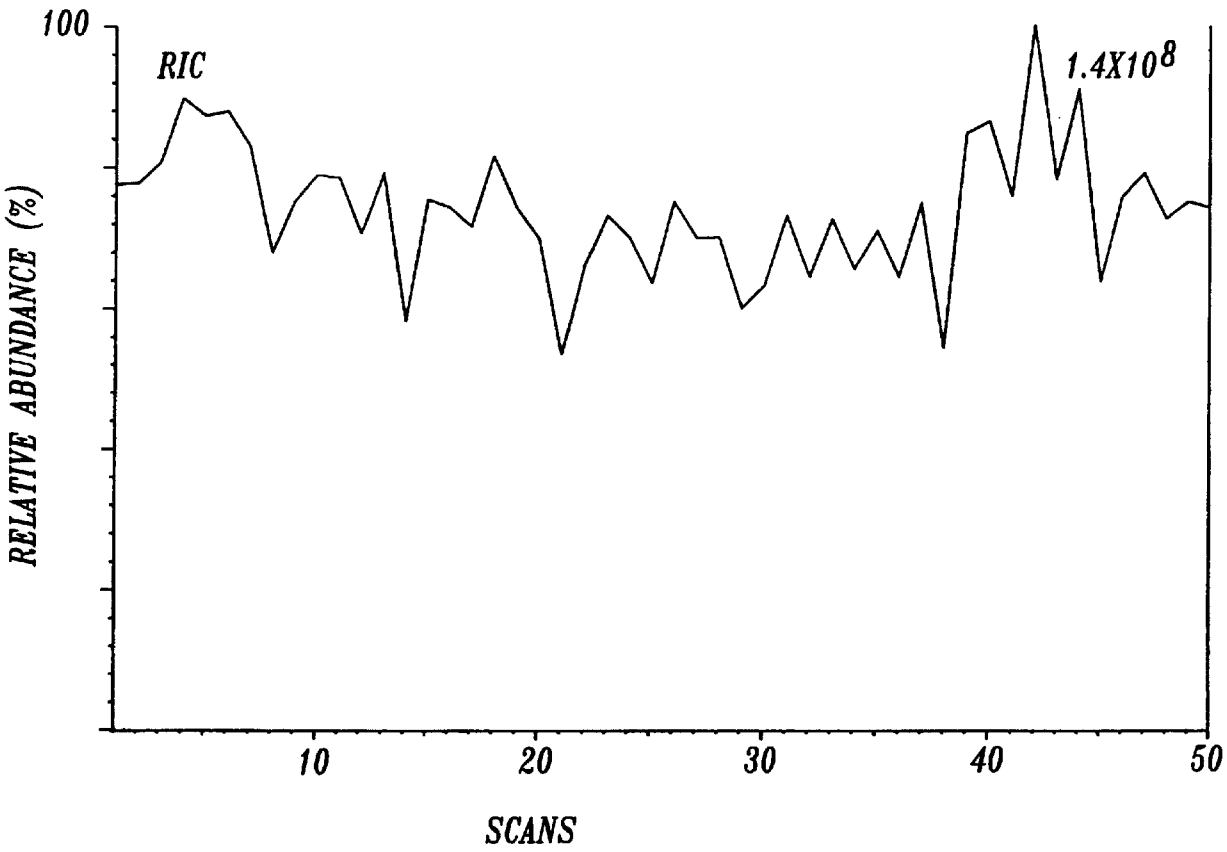
FIG. 7B is a reconstructed ion current plot for the mass spectrum shown in FIG. 7A.
Figure 13:
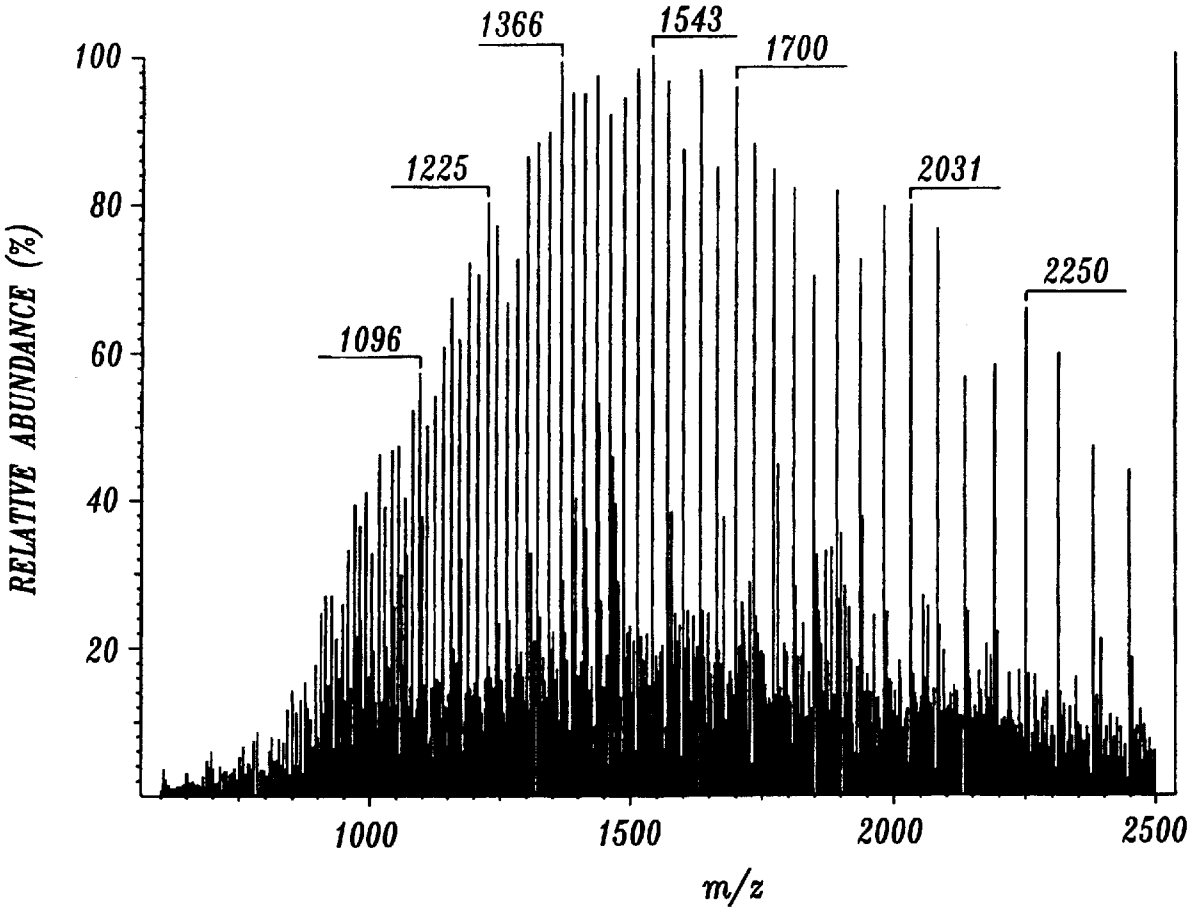
FIG. 13 is a mass spectrum of Factor XIII b subunit obtained from a mass spectrometer interfaced with a representative cylindrical capacitor ion source formed in accordance with the present invention with +2.0 kV applied to its central electrode (50 scans signal averaged)
Figure 14:
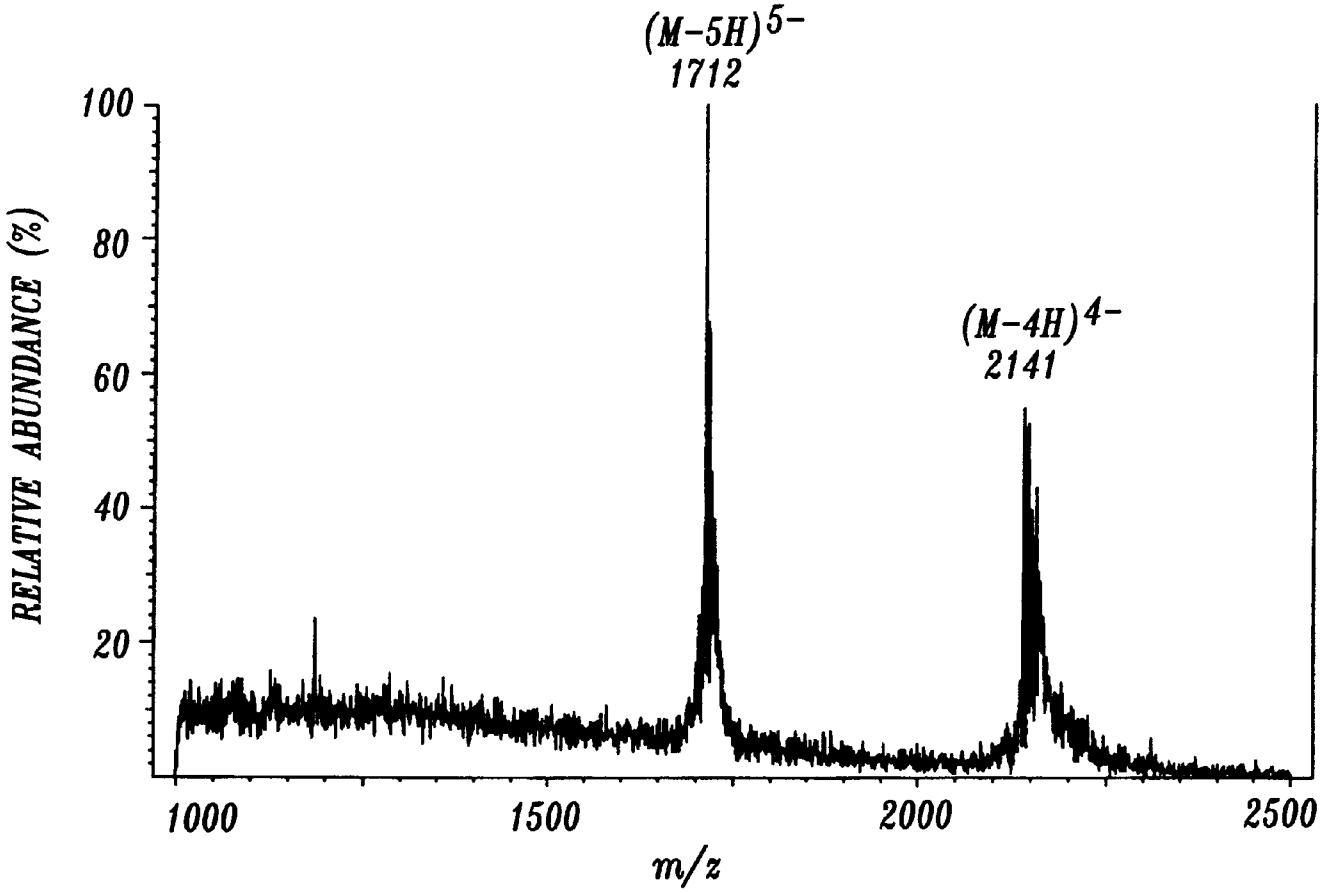
FIG. 14 is a negative ion mass spectrum of bovine ubiquitin obtained from a mass spectrometer interfaced with a representative cylindrical capacitor ion source formed in accordance with the present invention from a solution of bovine ubiquitin at pH 4 having a concentration of 500 amol/nL introduced into the ion source at a flow rate of 50 nL/min. (50 scans signal averaged)
Figure 15:
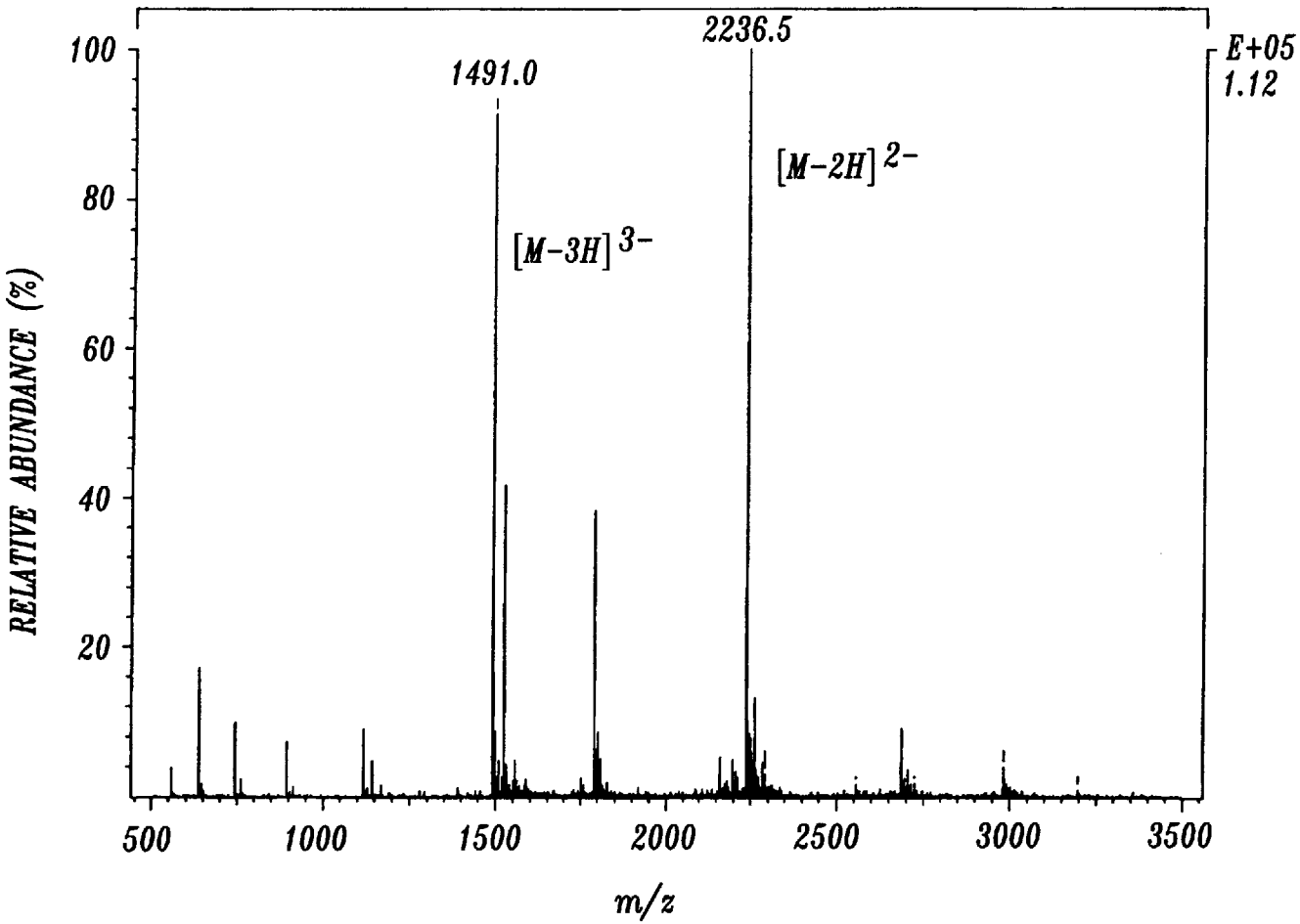
FIG. 15 is a negative ion mass spectrum of the oligonucleotide 5-d TCC TTC TGG TCT TCC obtained from a mass spectrometer interfaced with a representative cylindrical capacitor ion source formed in accordance with the present invention from a solution of the oligonucleotide in 50% acetonitrile/water having a concentration of about 1 pmol/μL infused into the ion source at a flow rate of 100 nL/min. (Voltage −1300 V, 7 scans signal averaged)
Figure 16:
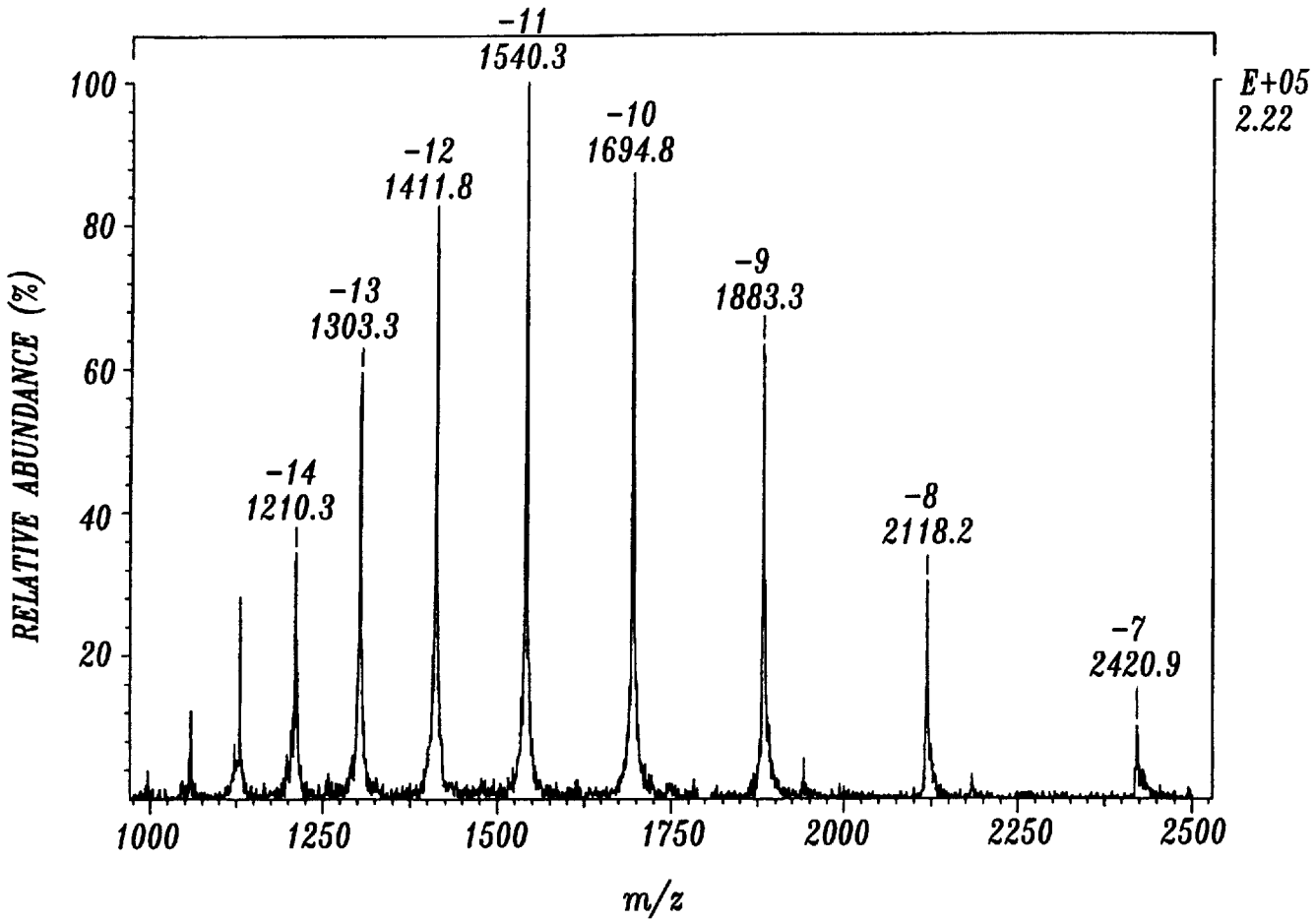
FIG. 16 is a negative ion mass spectrum of a horse skeletal muscle apomyoglobin obtained from a mass spectrometer interfaced with a representative cylindrical capacitor ion source formed in accordance with the present invention from a solution of the protein in 50% methanol/water with 1% acetic acid and having a concentration of about 5 pmol/μL infused into the ion source at a flow rate of 100 nL/min. (Voltage −1300 V, 13 scans signal averaged)
Figure 17:
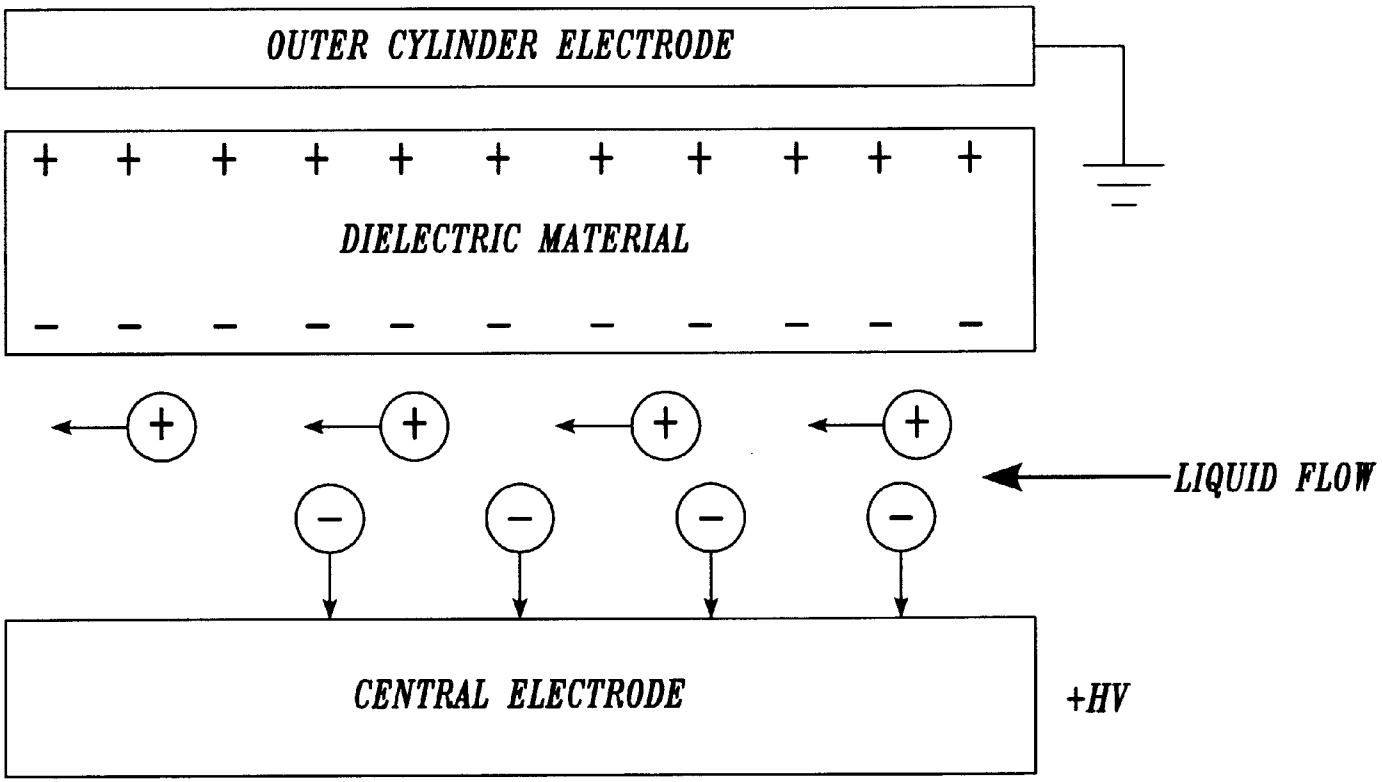
FIG. 17 is a schematic illustration of a method for forming ions using a representative cylindrical capacitor ion source formed in accordance with the present invention.

Representative mass spectra obtained from a commercial mass spectrometer interfaced with the ion source of this invention are illustrated in FIGS. 4A–10A, and 13–16. FIG. 4A shows the positive ion mass spectrum of human angiotensin I, a peptide having a molecular weight of 1296 grams/mole, which prominently displays a $[M+3H]^{3+}$ parent molecular ion at m/z 433 (M refers to the molecular ion and H refers to a proton attached to the molecular ion). Negative ion mass spectra of oxidized bovine insulin I-chain, molecular weight 2532 grams/mole, are shown in FIGS. 5A–8A. The mass spectra prominently display $[M-4H]^{4-}$ and $[M-3H]^{3-}$ parent ions at m/z 632 and 843, respectively. Negative ion mass spectra of lipid A, a complex glycolipid, shown in FIGS. 9A and 10A, display $[M-2H]^{2-}$ and $[M-H]^{-}$ ions at m/z 898 and 1797, respectively. FIG. 13 shows the positive ion mass spectrum of human Factor XIII b subunit, a blood coagulating factor having a molecular weight of 83,136 Daltons, and provides an example of mass analysis of a high molecular weight biomolecule on a mass analyzer having a nominal upper mass limit significantly less than the molecular weight of the analyzed molecule. Referring to FIG. 13, the mass spectrum shows a population of molecular ions having a range of charge states from about +100 to about +34. The negative ion mass spectrum of bovine ubiquitin shown in FIG. 14 displays $[M-5H]^{5-}$ and $[M-4H]^{4-}$ ions at m/z 1712 and 2141, respectively. FIG. 15 illustrates that the ion source of the present invention interfaced to a mass spectrometer can provide useful mass spectra for oligonucleotides. Referring to FIG. 15, the negative ion mass spectrum of a DNA 15-mer (i.e., 5-d TCC TTC TGG TCT TCC) displays $[M-3H]^{3-}$ and $[M-2H]^{2-}$ ions at m/z 1491.0 and 2236.5, respectively. The negative ion mass spectrum of apomyoglobin from horse skeletal muscle is shown in FIG. 16. The mass spectrum clearly depicts molecular ions having charge states ranging from −14 to −7.

As can be seen from these mass spectra, the ion source of the present invention efficiently and effectively produces positive and negative charged ions, including populations of multiply-charged molecular ions, from a variety of high molecular weight biomolecules.

The ion source of the present invention can also be incorporated into a mass spectrometer having dual ion sources. In such a configuration, the dual source mass spectrometer can include one or two ion sources of this invention. For dual source mass spectrometers incorporating a pair of ion sources of this invention, one source can be employed to provide a mass calibrant while the other forms analyte ions for analysis. In a second dual source configuration, both ion sources form analyte ions, one source operating in negative ion mode and the other source operating in positive ion mode. In this configuration, positive and negative ion mass spectra can be obtained for an analyte on alternating scans.

The ion source of the present invention can be interfaced to a mass analyzer as an ion generator. However, devices of the present invention can also be advantageously employed in a wide variety of applications. For example, the ion sources of the invention can be used to create a highly sensitive electrochemical detector for liquid chromatography (HPLC) or ion chromatography. Such a device offers improvements over existing liquid chromatography detection based on capacitance, resistance, voltage, or current.

The device can also be readily adapted to any industrial process that requires the spraying of small droplets at low flow rates without the complications introduced by high externally applied voltages. For example, the device of the present invention can be used for spraying fluids during the manufacture of printed circuit boards in the electronic industry. Other applications include solvent spraying to clean parts during the microfabrication of miniature mechanical devices.

One of the advantages provided by the present invention is the versatility of the ion source with respect to the liquid sample. Generally, the liquid sample includes one or more neutral polyatomic molecules from which ions are formed. The liquid sample can be an aqueous solution including, for example, a buffered aqueous solution. Buffered aqueous solutions include commonly used biochemical buffers including, for example, phosphate, glycine, citrate, formate, acetate, borate, EDTA, HEPES (hydroxyethylpiperazine ethanesulfonic acid), and TRIS (tris(hydroxy-methyl) aminomethane) buffers. Other useful aqueous solutions include solutions that contains detergents and surfactants. The pH of the aqueous solution can range from strongly acidic to strongly basic. Solutions having pH from 3–9 have been routinely used to provide useful mass spectra using the ion source of this invention. Moreover, the ion source of the invention generally overrides solution acidity and effectively generates negative ions from strongly acidic solutions. Alternatively, the liquid sample can be an organic solution or an aqueous solution that includes one or more organic solvents. Organic solvents are commonly utilized to increase the solubility of an analyte in the liquid sample. Generally used solutions include combinations of water and polar organic solvents such as acetonitrile, methanol, ethanol, n-propanol, and isopropanol. For lipophilic analytes, combinations of polar aprotic solvents (e.g., chloroform) and alcohols (e.g., methanol, isopropanol, 2-methoxyethanol) are commonly used. Thus, because of the variety of liquid samples that may be accommodated by the device of the present invention, ions can be formed from polyatomic molecules having a wide range of solubility properties that would ordinarily limit their ability to be analyzed by other ionization methods.

In another aspect, the present invention provides a method for generating ions by inductive ionization from a liquid sample containing one or more neutral polyatomic molecular species. In the method, the liquid sample is introduced into an ion source that includes a capacitor having a pair of electrodes separated by a dielectric material. On application of a direct current voltage to the capacitor, the dielectric material is inductively charged and, ultimately, ion formation occurs. Because the method forms ions from neutral polyatomic molecules present in the liquid sample, the method can be used for forming ions for mass spectral analysis. Accordingly, the present invention provides a method for determining the molecular weight of molecules when the ions formed in the method are introduced into a mass analyzer. When the ions formed in the method include fragment ions (i.e., ions formed from the fragmentation of the parent molecule) the present invention provides a method for determining the mass of the polyatomic fragment species.

The device and method of the present invention offer numerous practical advantages compared to existing ionization methods. The device and method provide increased signal stability and sensitivity over a wide range of solution conditions and flow rates. In addition, for certain high molecular weight biomolecules, the ion source of this invention facilitates the production of useful mass spectra that are either difficult to obtain or impossible to obtain by other ionization methods.

Figure 23A:
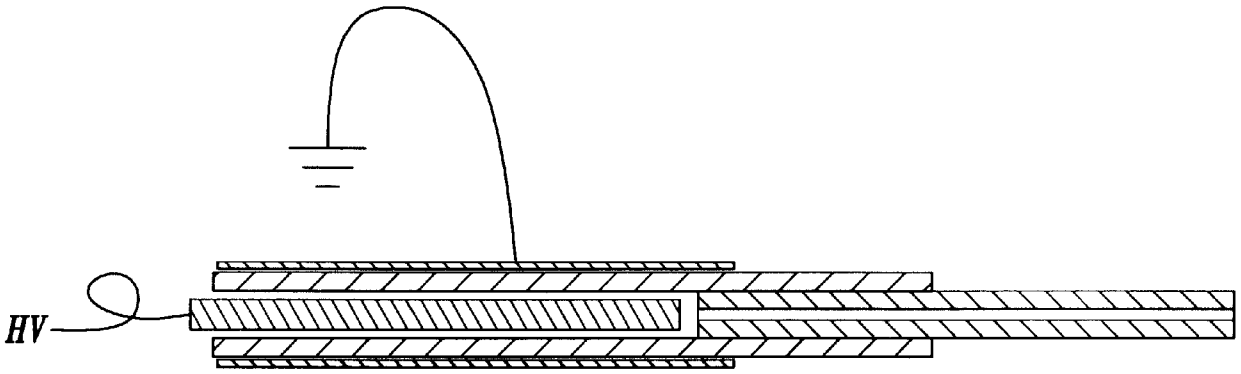
FIG. 23A is a cross-sectional view of a representative cylindrical capacitor ion source formed in accordance with the present invention.
Figure 23B:
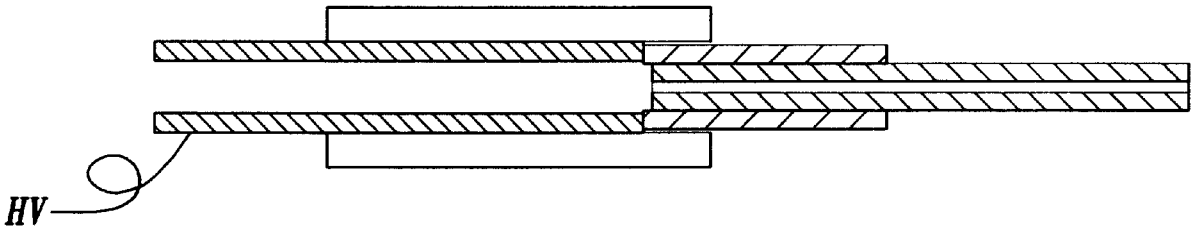
FIG. 23B is a cross-sectional view of a representative liquid junction ion source.
Figure 23C:
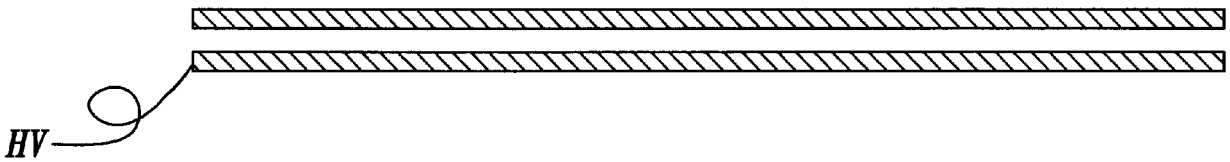
FIG. 23C is a cross-sectional view of a representative electrospray ion source.

The performance of a representative cylindrical capacitor ion source formed in accordance with the present invention has been compared to a liquid junction ion source and a conventional electrospray ion source for several samples. FIGS. 23A–C are schematic representations of the cylindrical capacitor (A), liquid junction (B), and electrospray (C) ion sources, respectively. The signal improvement observed for the cylindrical capacitor compared to the liquid junction ion sources (A/B) and for the cylindrical capacitor compared to the electrospray ions source (A/C) for various samples are summarized in FIG. 24. In FIG. 24, TFP, DIP, TFPoxaz, OMeTFP, and OMeTFAim refer to propranolol derivatives.

The following examples are provided for the purposes of illustration, not limitation.

EXAMPLES

The reagents and materials used in the following examples were obtained from the following sources. High purity water (18 MΩ-cm) was obtained from a Barnstead-Nanopure UV system; and acetonitrile (Burdick and Jackson, Muskegon, Mich.), glacial acetic acid (Sigma 99.99% grade), methanol (Fisher Optima), chloroform (Baker Photrex) and 2-methoxyethanol (Fluka) were used as received. *Salmonella typhimurium* diphosphorylated lipid A (Ribi Immunochem, Hamilton, Mont.), Human angiotensin I, bovine insulin I-chain, bovine ubiquitin, and intact horse apomyoglobin (all obtained from Sigma Chemical Co., St. Louis, Mo.) were used as standards. The horse apomyoglobin tryptic digest was provided by the Department of Biochemistry, University of Washington, Seattle, Wash. and recombinant human Factor XIII was provided by Zymogenetics Corp., Seattle, Wash.

Example 1

The Construction and Operational Characteristics of a Representative Ion Source

In this example, the construction and operational characteristics of a representative ion source of the present invention are described. Generally, the ion source includes a capacitor having a concentric cylindrical configuration that includes a central electrode and a surrounding cylindrical electrode separated by a fused silica dielectric material. The representative ion source constructed as described below can be interfaced to a mass spectrometer as described in Example 2.

A representative ion source was constructed from a fused silica capillary, 75 μm i.d.×185 μm o.d.×5 cm (Polymicro Technologies Inc., Phoenix, Ariz.) by inserting a 50 μm diameter platinum wire (Goodfellow Corp., Berwyn, Pa.) into the fused silica capillary and then surrounding the capillary/electrode assembly with a 27 gauge stainless steel capillary tube (Small Parts Inc., Miami Lakes, Fla.). An alternative outer electrode was prepared by covering the same length of capillary tube with carbon paste (Neubauer Chernikalien, Germany). The outer cylindrical electrode (e.g., either the stainless tubing or carbon paste) was grounded to earth potential. The platinum wire was then placed through the bore of a microvolume PEEK cross (Valco Instruments Co. Inc., Houston, Tex.). Both the platinum wire and fused silica capillary were attached to the PEEK cross by a finger-tight fitting (Upchurch, Oak Harbor, Wash.) having a 180 μm i.d.×1.59 mm o.d.×2 cm Teflon sleeve (Valco). The length of the wire was adjusted such that the end of the wire was just inside the outer end of the stainless steel tubing. The platinum wire was connected to the high voltage lead from the Finnigan API direct current voltage power supply. The construction was tested at +3.5 kV and no breakdown of the dielectric was observed. The other two cross inlets were used as sample and optional, auxiliary make-up liquid inlets. A separate fused silica capillary exit line, 20 μm i.d., was secured by gluing with epoxy to the 75 μm inner capillary, for use at 500 nL/min or lower flow rates. The above-described construction is illustrated in FIGS. 1 and 2.

The operational characteristics of a representative ion source constructed as described above and its performance relative to a conventional electrospray ion source is described below. With regard to applied voltages, the voltage applied to the capacitor of the ion source of the present invention was about one-third to one-half the voltage required to achieve a comparable ion current using an ES ion source. For the ion source of this invention, voltages ranging from about 1.3 to about 1.6 kV were sufficient to form negative ions at 200 nL/min. For negative ions, the optimal applied voltage was found to be dependent on flow rate. While the minimum voltage above threshold required for the appearance of signal remained relatively constant at 1.3 kV, the maximum voltage for a stable signal decreased with increasing flow rate for Lipid A dissolved in 2-methoxyethanol solvent. For positive ions, voltages ranging from about 1.6 to about 2.2 kV were sufficient to achieve comparable ion currents as observed using an ES ion source. The maximum voltage for stable operation was found not to be flow rate dependent in the range from 50 nL/min. to 10 μL/min. For those analytes for which it was possible to obtain low flow rate ES ionization data of reasonable quality, the main beam and product ion mass spectra were qualitatively similar to those observed with the ES ion source on the same instrument. For the experiments noted above, identical optimized quadruple and lens tuning conditions were used for ions produced with the ion source of this invention and with an ES ion source.

Microscopic observation of the spray emerging from the ion source of this invention and an ES ion source revealed similarities and differences. Observations of the spray were made with a dissecting microscope at 100× magnification during infusion of angiotensin I, lipid A, and insulin α-chain into the Finnigan mass spectrometer. For the ion source of this invention, a sharp cone clearly emerged from the meniscus at the spray tip at high flow rates in positive ion mode. However, the cone was not observed at 100× magnification for low flow rates or in negative ion mode at any flow rate up to 500 nL/min. The signal strength was observed to be independent of the presence of the cone or to the vibrating instability mode observed when the spray attempted to reequilibrate after a change in the flow rate. The vibrating instability mode was similar to that observed in ES ionization. The sharp, thin stream observed emanating from the tip of the ion source of the present invention in positive ion mode at all flow rates contrasted with the more diffuse, less focused spray observed under all flow rate conditions in negative ion mode. The fine beam emanating from the cone observed in positive ion mode, similar in appearance to the beam reported for ES ion sources, was found not to be dependent on the presence of a pressure gradient or a counterelectrode.

Experiments with the ion source of this invention interfaced with a Sciex API III+ mass spectrometer utilizing a heated nitrogen gas curtain, rather than a heated capillary, yielded similar positive ion results for apomyoglobin compared to those results observed using a small inner diameter needle modification of the Sciex ion spray interface.

Example 2

Interfacing a Representative Ion Source to a Mass Spectrometer

A representative ion source of the present invention, constructed as described above in Example 1, was interfaced with a mass spectrometer as described in this example.

A Finnigan MAT TSQ 7000 (Finnigan Corp., San Jose, Calif.) triple quadrupole mass spectrometer having an API interface was used for all experiments described in the following examples except where the Sciex API III+ mass spectrometer (PE-Sciex, Thornhill, Ontario, Canada) is specifically noted. The mass spectrometer's original ES ionization rear block, containing the high voltage portion of the interface, was replaced by the ion source construction described in Example 1 above. The heated capillary portion of the Finnigan interface was retained without modification. The capillary was held at a temperature of 180° C. except for the 50 μL/min high flow experiment, which was performed at 250° C. Voltages applied to the lenses and mass filters did not differ from those employed in low flow ES experiments. The sheath and auxiliary gas lines normally employed with the commercial ESI/API interface were disconnected.

Example 3

Representative Ion Source Signal Linearity

The linearity of ion signal was determined using a representative ion source of the present invention constructed as described in Example 1 and interfaced to a commercially available mass spectrometer as described in Example 2 by the procedures described in this example.

A positive ion calibration curve was constructed by directly infusing a solution of angiotensin I using a syringe pump and a 75 μm i.d. fused silica transfer line at a rate of 200 nL/min in 1:1 acetonitrile/water 0.5% acetic acid. Three determinations were made for the peak height of m/z 433 at each concentration level by averaging three centroid scans, 350 to 600 m/z at 1.0 sec/scan, with an electron multiplier setting of 1400 V. Concentration detection limits for infusion were calculated based on a criteria of 3× the standard deviation of the baseline noise. For the high flow experiment at 50 μL/min, infusion experiments were carried out with angiotensin I, 1 pmol/μL in 1:1 acetonitrile/water 0.5% acetic acid, scanning in Q1 from 350 to 1400 m/z at 0.5 sec/scan.

Figure 3:
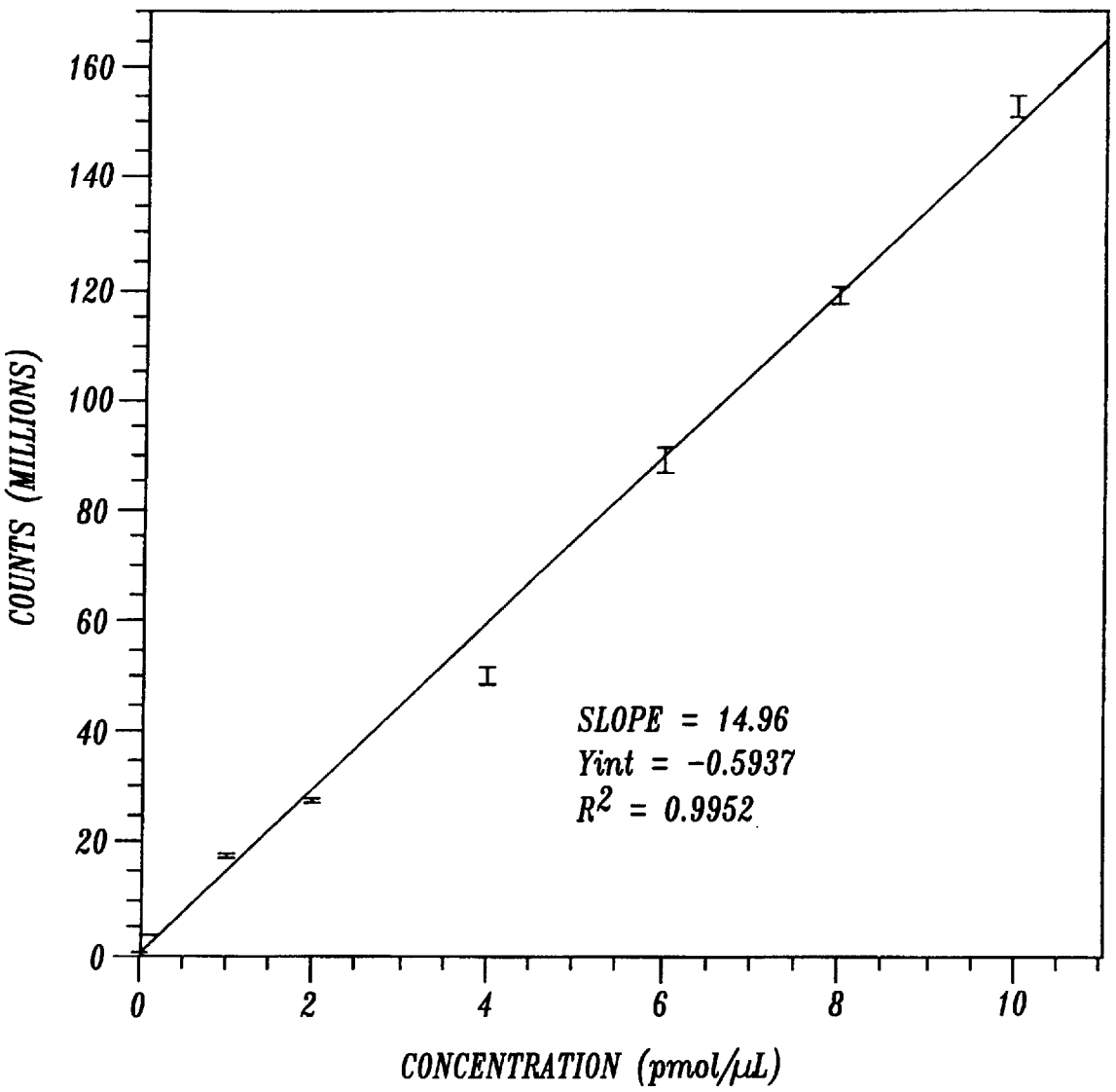
FIG. 3 is a positive ion calibration curve for angiotensin I at concentrations from 1 fmol/μL to 10 pmol/μL obtained from a mass spectrometer interfaced with a representative ion source formed in accordance with the present invention.

The calibration curve for angiotensin I is shown in FIG. 3. Signal linearity was observed over a concentration range of four orders of magnitude for positive ion signals from angiotensin I infusion. The infusion concentration detection limit for the angiotensin I $[M+3H]^{3+}$ ion at m/z 433 was determined to be 5 fmol/μL at a flow rate of 200 nL/min.

Example 4

The Effect of Flow Rate on Mass Spectra

In this example, the effect of liquid sample flow rate on mass spectra obtained using a representative ion source of this invention is described.

Employing a 20 μm i.d. fused silica capillary as an ion outlet exiting the capacitor-based ion source, stable spray conditions could be maintained with flow rates as low as 50 nL/min. However, in negative ion mode, a gradual decrease in signal strength was observed for a fixed concentration of insulin α-chain at flow rates below 80 nL/min. See FIGS. 5B–8B. When the flow rate was increased, the expected signal returned at about the same rate that it disappeared. The experiment was repeated several times with identical results suggesting that a threshold flow rate was necessary to sweep the charged species from the ion source. With a 75 μm exit line, all negative ions showed this behavior at 50 nL/min flow rate. Adjustments to the applied high voltage and analyte concentration did not affect this process in any observable way. It is suspected that ions were still being formed at flow rates below the threshold, but remained bound to the surface of the fused silica capillary dielectric adjacent the cylindrical electrode. Referring to FIG. 1, the sample inlet is positioned such that the liquid contacts the platinum wire before entering the capacitor proper. Thus, the opportunity for electrophoresis and ion migration back toward the grounded syringe does exist, but becomes a practical issue at only the very lowest flow rates, i.e., below about 50 nL/min in most cases. Once an ion enters or is formed in the capacitor-based ion source, back migration is unlikely due to the close proximity of the grounded counter electrode. For low flow rate experiments, ion outlet capillaries having 15 to 25 μm i.d. appear to be a good compromise in terms of maintaining both the minimum required pressure and liquid velocity exiting the capacitor and also minimizing clogging problems with real samples of biological origin.

Example 5

The Formation of Negative Ions From Biomolecules

Negative ions can be formed from biomolecules using the ion source of the present invention. This example describes the formation of negative ions from *Salmonella typhimurium* diphosphorylated lipid A and oxidized bovine insulin α-chain using a representative ion source of the present invention interfaced to a commercial mass spectrometer.

Lipid A. *Salmonella typhimurium* diphosphorylated lipid A, a complex material with many minor components, was infused at concentrations of 100 pmol/μL in 80% 2-methoxyethanol:20% chloroform, without addition of base, scanning Q1 in negative ion mode from 50 to 2000 m/z at 2 sec/scan. Product ion spectra were acquired for the $[M-2H]^{2-}$ precursor ion at m/z 898 using a collision offset of +35 V and argon collision gas at a gauge pressure (uncorrected) of 3 mTorr in Q2.

Figure 9D:
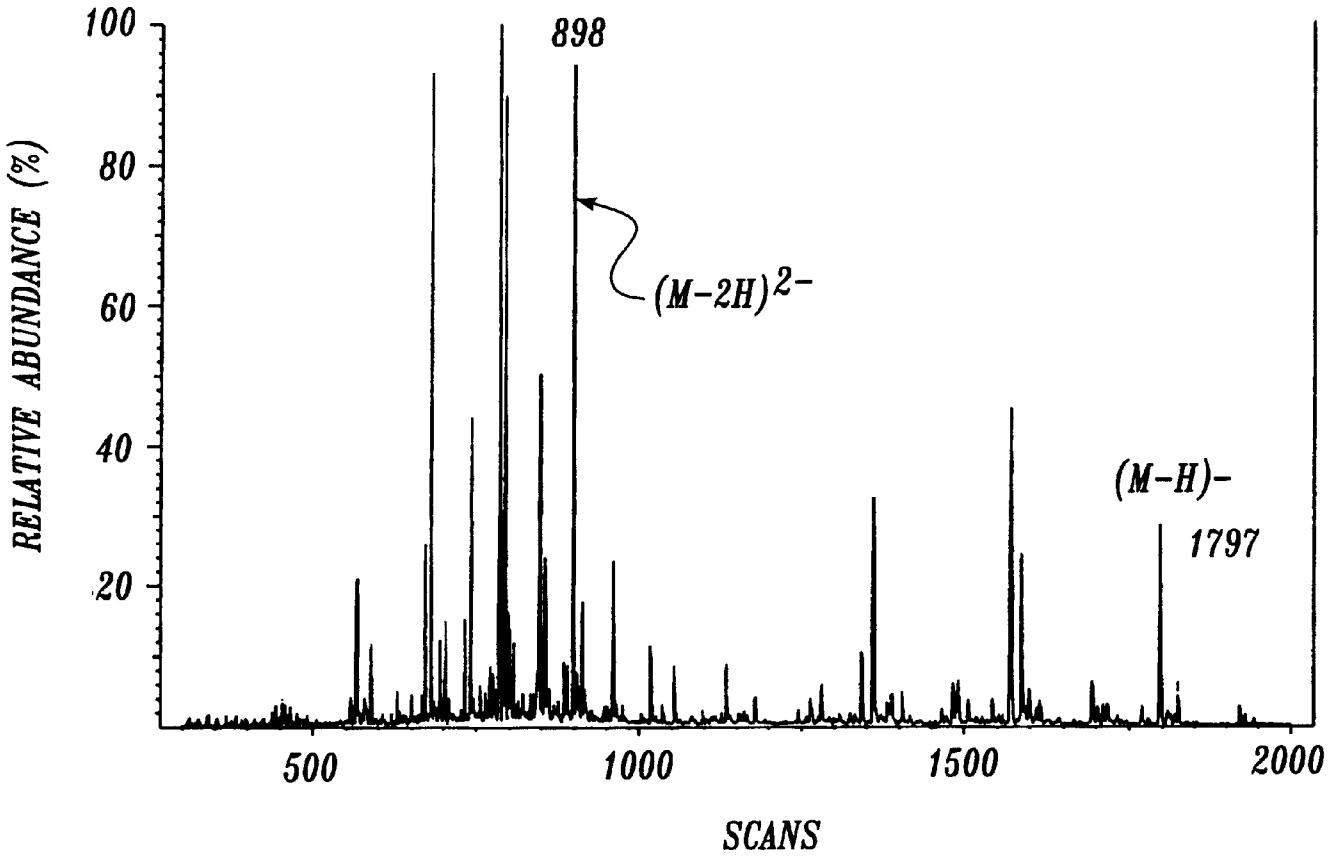
FIG. 9A is a negative ion profile mode mass spectrum for lipid A (100 pmol/μL infused at 50 nL/min., signal averaging for 15 scans, electron multiplier voltage 1400 V, RIC counts about $10^8$)
FIG. 9B is a reconstructed ion current plot for the mass spectrum shown in FIG. 9A.
Figure 9B:
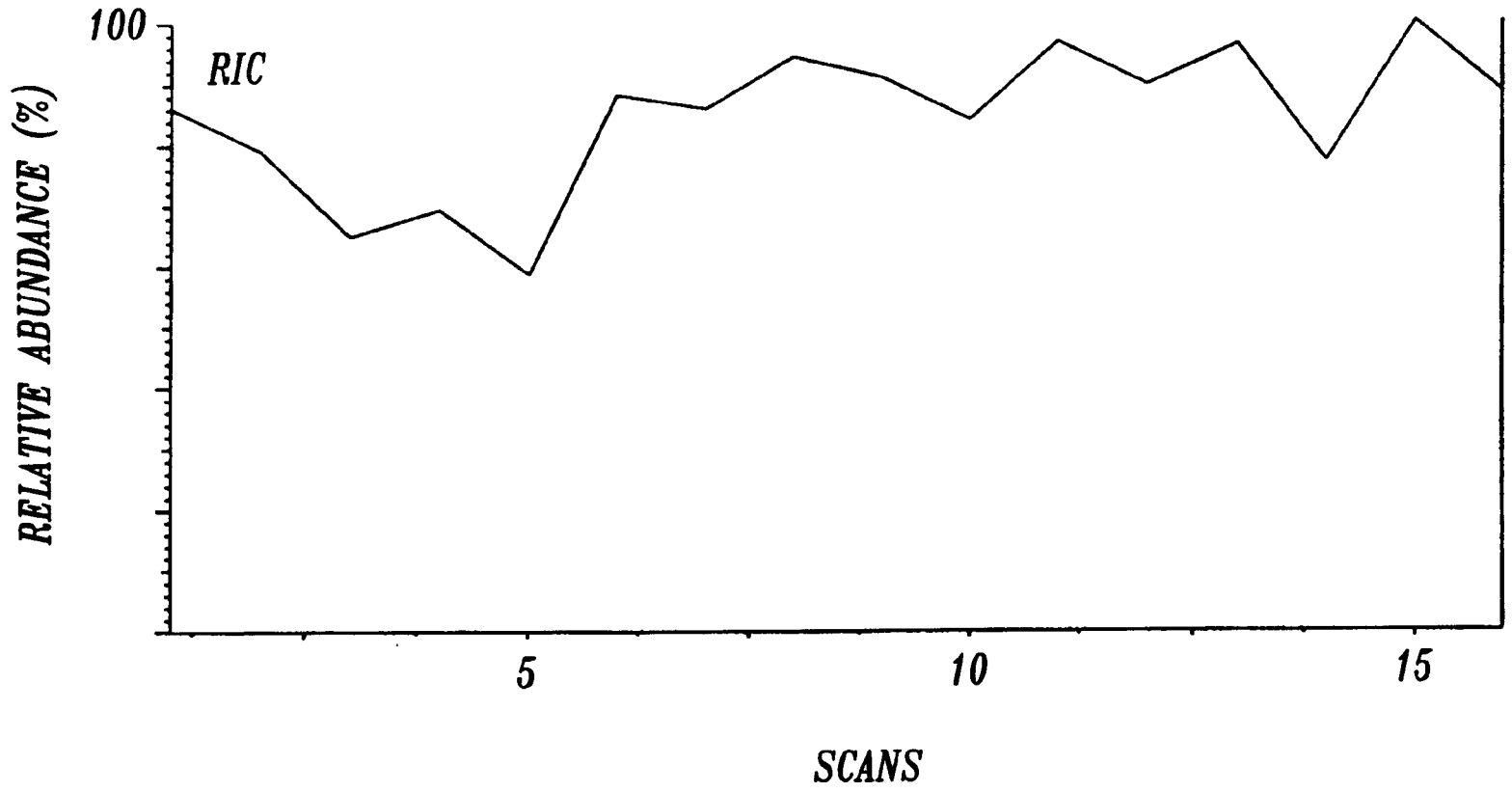
Figure 10A:
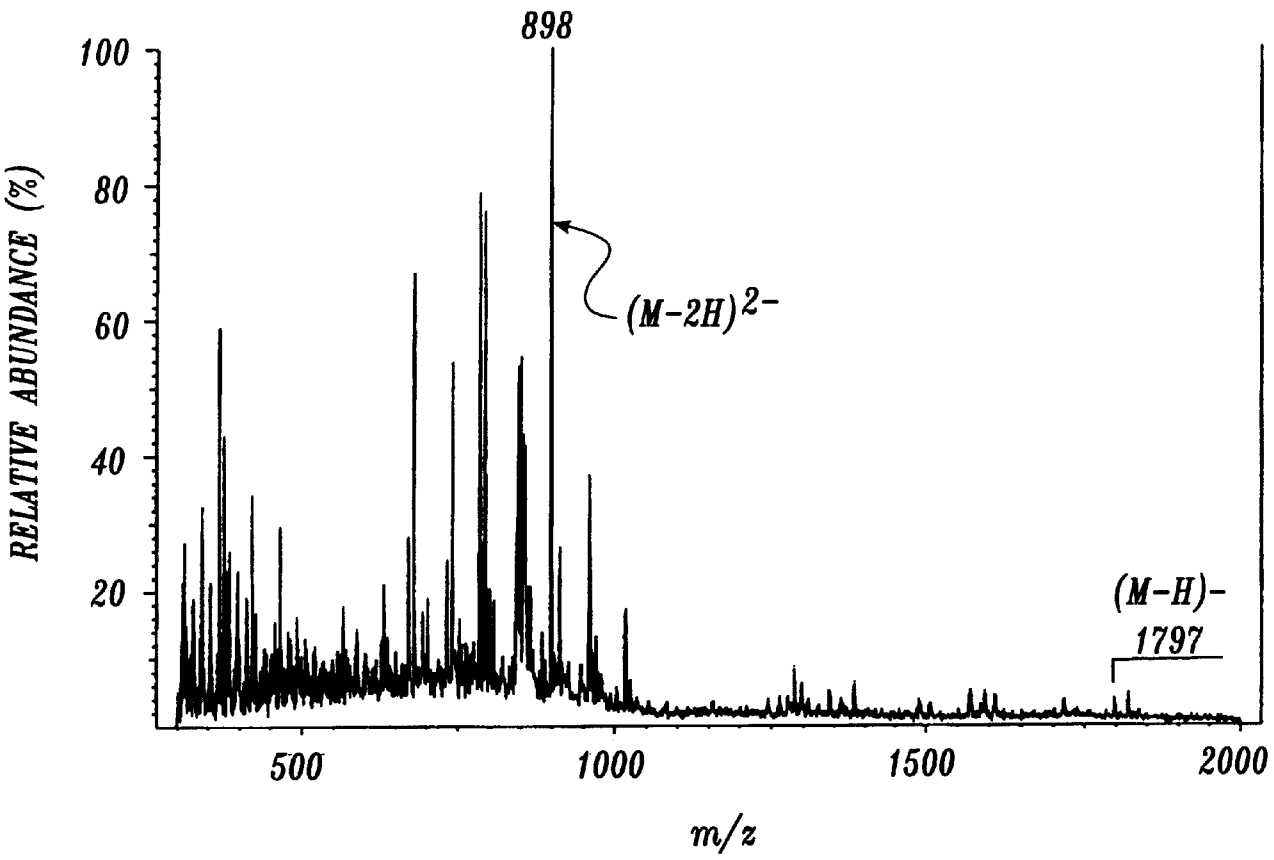
FIG. 10A is a negative ion profile mode mass spectrum for lipid A (200 fmol/μL infused at 50 nL/min., signal averaging for 15 scans, electron multiplier voltage 1400 V, RIC counts about $10^7$)
Figure 10B:
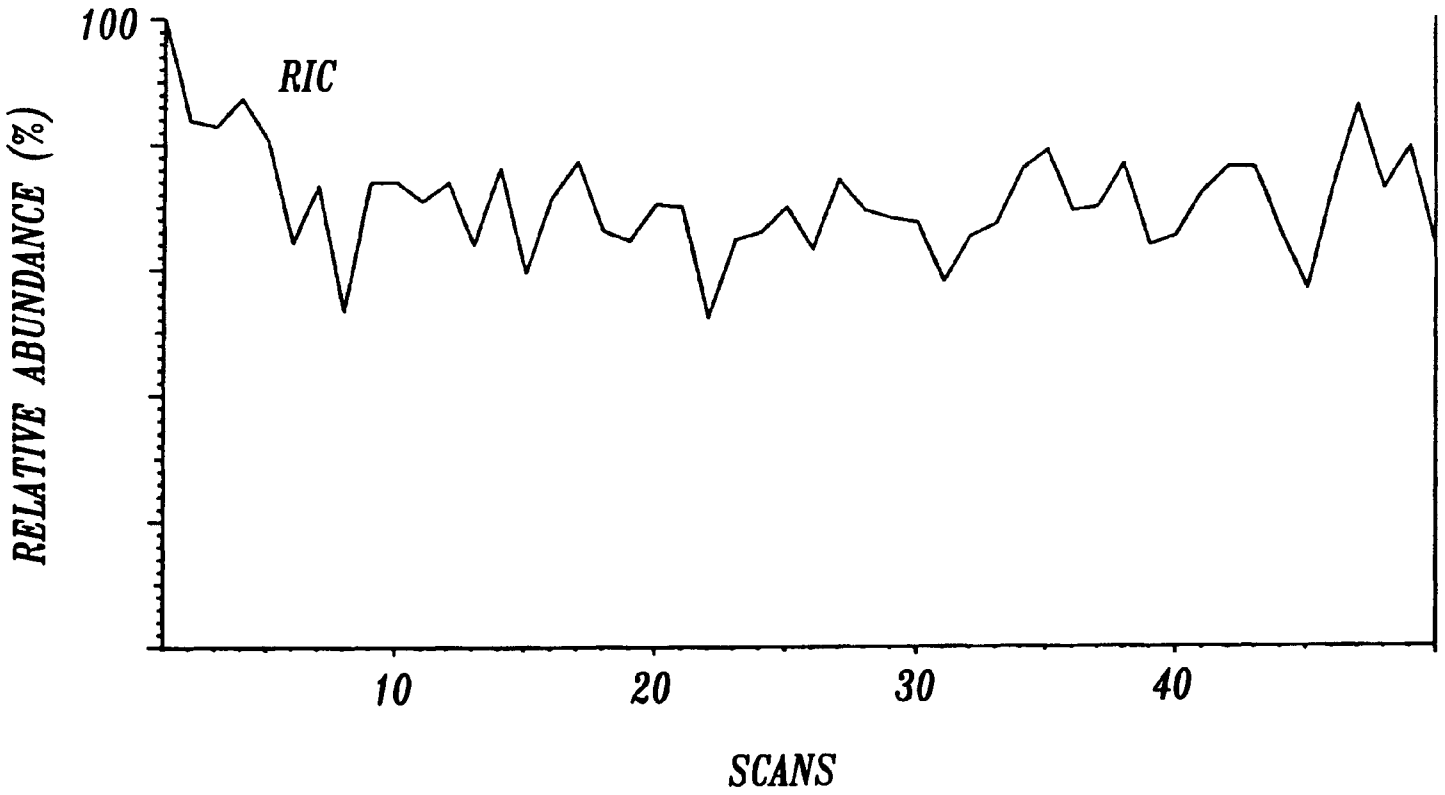
FIG. 10B is a reconstructed ion current plot for the mass spectrum shown in FIG. 10A.

The infusion concentration detection limits for the $[M-2H]^{2-}$ molecular anion from lipid A were improved by a factor of about a 500 relative to the best results obtained with a commercial ES interface. FIG. 9A shows the mass spectrum acquired using the ion source of this invention at 100 pm/μL, which is substantially similar to the results obtained on the same instrument using an ES interface. FIG. 10A shows the mass spectrum obtained from the same sample diluted to 200 fmol/μL and run under identical conditions. We have been unable to generate usable mass spectra with an ES interface at concentrations below 100 pmol/μL for this type of molecule. The results shown in FIGS. 9A and 10A become even more significant in view of the fact that lipid A is sprayed under negative ion ESI conditions at 50 nL/min only with great difficulty. No molecular signal is normally observed under positive ion conditions with either interface. At 200 fmol/μL, the S/N for the $[M-2H]^{2-}$ ion (i.e., about 100:1) at m/z 898 was sufficient to generate an interpretable product ion spectrum. One pmol of lipid A was a sample sufficient for infusion for up to 100 minutes, which is time sufficient to perform many MS/MS experiments. The observed collisionally activated dissociation (CAD) spectra did not differ significantly from published negative ion product ion spectra of lipid A. Note that in FIG. 9A the relatively greater contribution of the $[M-H]^{-}$ ion to the reconstructed ion current (RIC) at the higher concentration. This trend is generally observed in all negative ion data suggesting that in all negative ion data higher charge states are favored at lower concentrations. A solvent system containing chloroform in 80% 2-methoxyethanol was favored for signal stability over the more commonly used chloroform/methanol. As with other negative ion methods in mass spectrometry, the signals observed using the ion source of the present invention were nonlinear with increasing concentration, as indicated by the reconstructed ion current plots for lipid A shown in FIGS. 9B ($10^7$ counts) and 10B ($10^8$ counts).

Figure 8A:
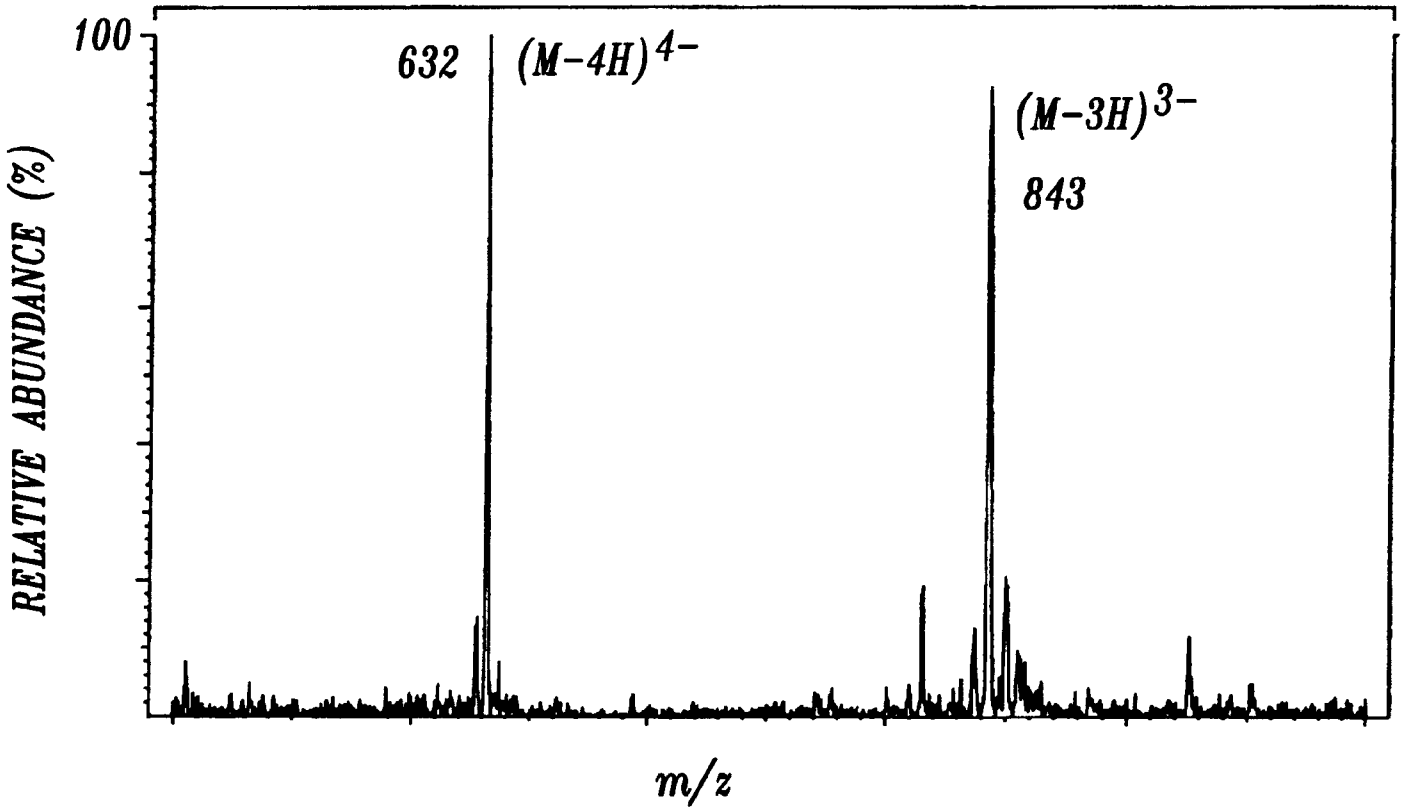
FIG. 8A is a negative ion mass spectrum of insulin α-chain (5 pmol/μL infused at 500 nL/min.) obtained from a mass spectrometer interfaced with a representative ion source formed in accordance with the present invention.
Figure 8B:
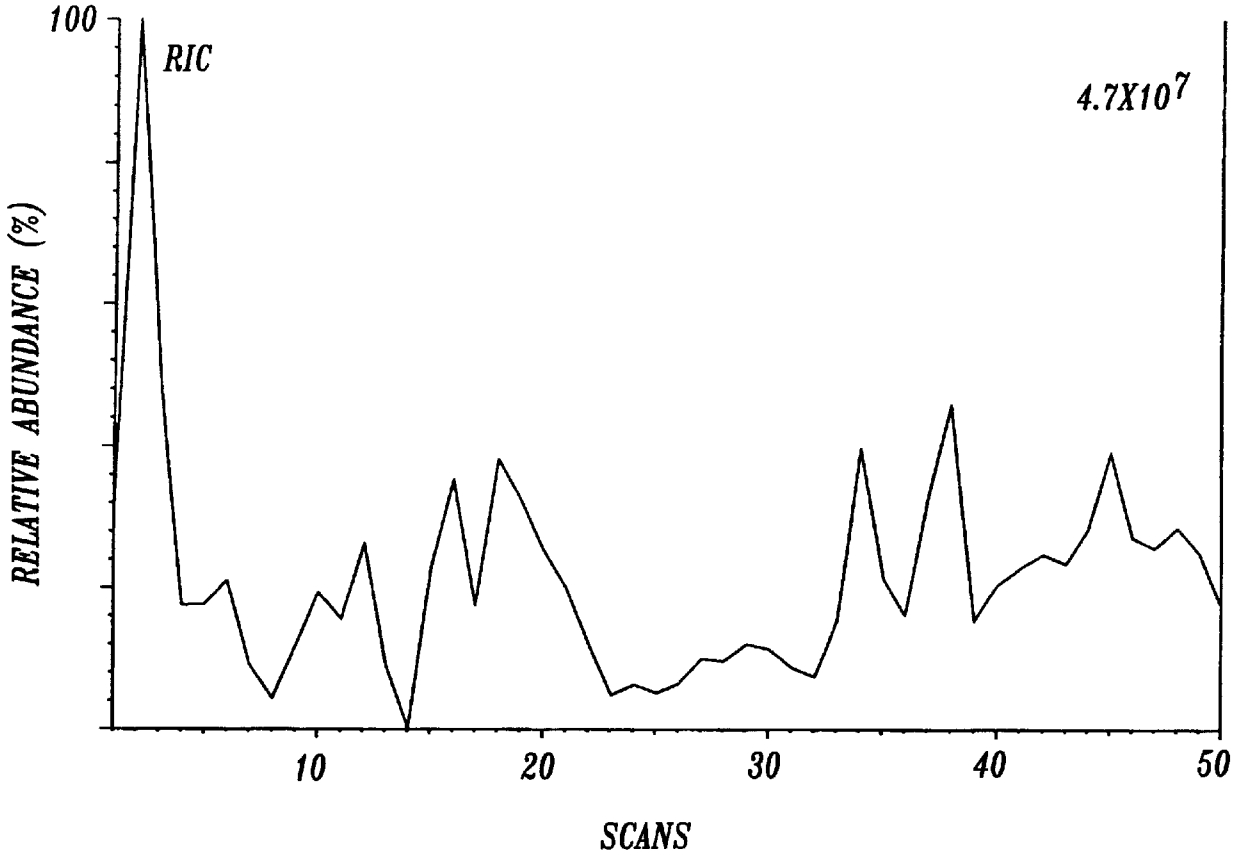
FIG. 8B is a reconstructed ion current plot for the mass spectrum shown in FIG. 8A.

Insulin α-chain. Bovine insulin α-chain, $M_r$ 2532, 5 pmol/μL, was infused in 1:1 acetonitrile/water to examine the signal at a fixed concentration under a range of flow rate conditions. Results obtained for insulin α-chain, an acidic peptide, were also improved compared to those achieved with negative ion low flow ESI. On an ESI system, low microliter/min. flow rates were required to generate useful signals for the peptide. FIGS. 5A–8A show mass spectra and FIGS. 5B–8B show RIC baselines acquired at flow rates from 50 nL/min to 500 nL/min using the ion source of this invention. Similar results could be readily obtained with liquid sample solutions containing up to 95% water. No additional base was found to be necessary, and the only observed consequence of additional base (e.g., triethylamine or ammonium hydroxide) at any concentration tested (1 μM to 10 mM) was signal suppression. At the highest flow rate, an increase in the relative abundance of the −3 charge state was noted as shown in FIG. 8A.

Example 6

The Formation of Positive Ions From Biomolecules

Positive ions can be formed from biomolecules using the ion source of the present invention. In this example, the formation of positive ions from a tryptic digest of horse apomyoglobin and recombinant human Factor XIII using a representative ion source of the present invention interfaced to commercial mass spectrometer is described.

Horse Apomyoglobin Tryptic Digest. A tryptic digest of horse apomyoglobin was analyzed in positive ion mode introducing the sample to the ion source by capillary liquid chromatography (LC) using a representative ion source of the present invention and a modified ES interface. For the positive ion capillary LC experiments, 250 fmol of acidified (pH 3) apomyoglobin tryptic digest was pneumatically loaded on a 13 cm fused silica column, 50 μm i.d.×185 μm o.d., packed with Monitor C18 modified silica (Column Engineering, Ontario, Calif.). This experiment was performed with a representative ion source of the present invention constructed as described in Example 1 and a small needle modification of the Finnigan ESI source. A 25 minute gradient from 0 to 75% acetonitrile at a flow rate of 150 nL/min was used in both cases. For purposes of comparison, a make-up liquid consisting of 1:1 methanol/water (v/v) and 0.4% acetic acid by volume and infused at 180 nL/min was used with both interfaces. The capillary LC device, sample loading bomb and precolumn splitter were constructed in our laboratories. The capillary LC inlet is based on previously published work by Jorgenson and Tomer and its implementation by Hunt. See, *Anal. Chem.* 1989, 61, 1128–1135; *Anal. Chem.* 1991, 63, 1467–1473; and *Techniques in Protein Chemistry II*, Villafranca, J. J., Ed. 1, Academic: New York, 1991, pp. 441–454.

Figure 11:
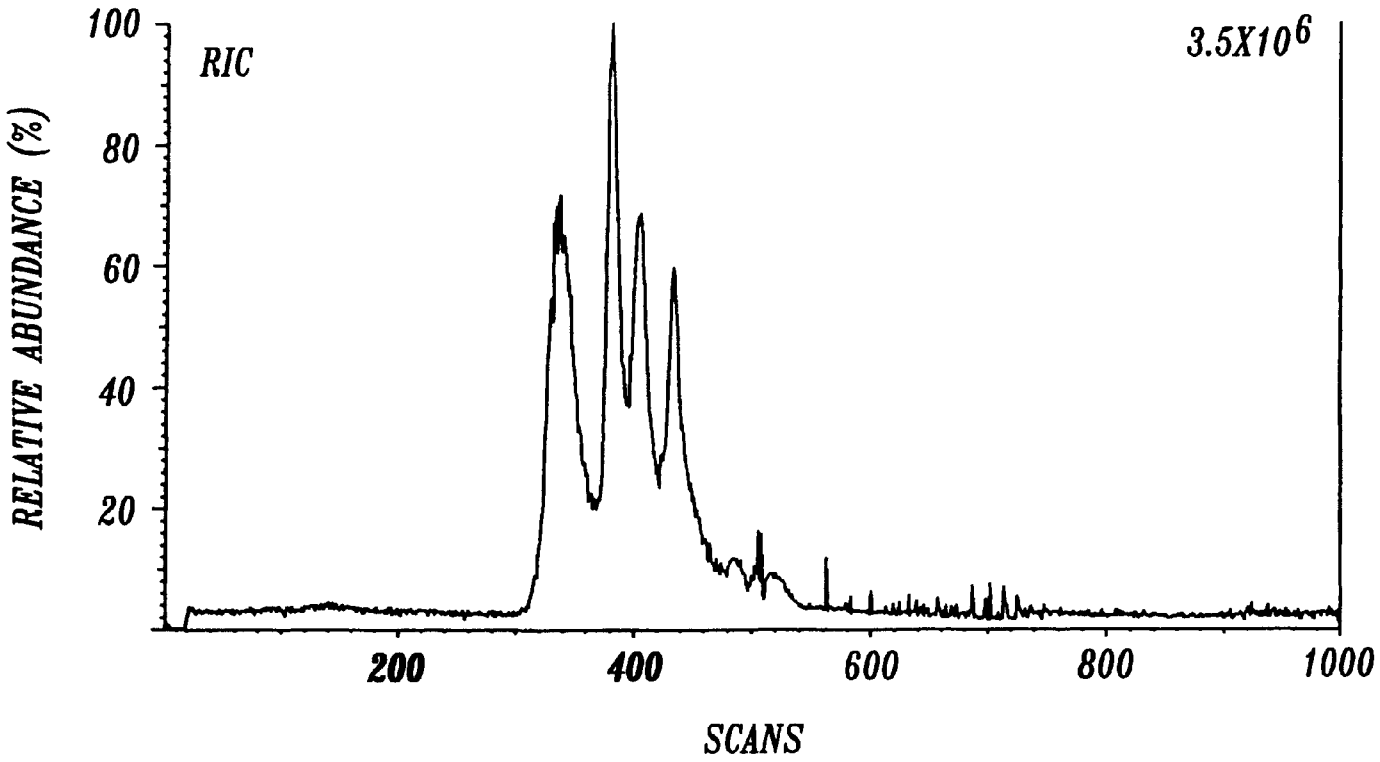
FIG. 11 is a reconstructed positive ion chromatogram for apomyoglobin tryptic digest introduced into an electrospray ion source by capillary LC/MS and with +3.1 kV applied to the source's stainless steel needle and with an electron multiplier voltage of 1000 V.
Figure 12:
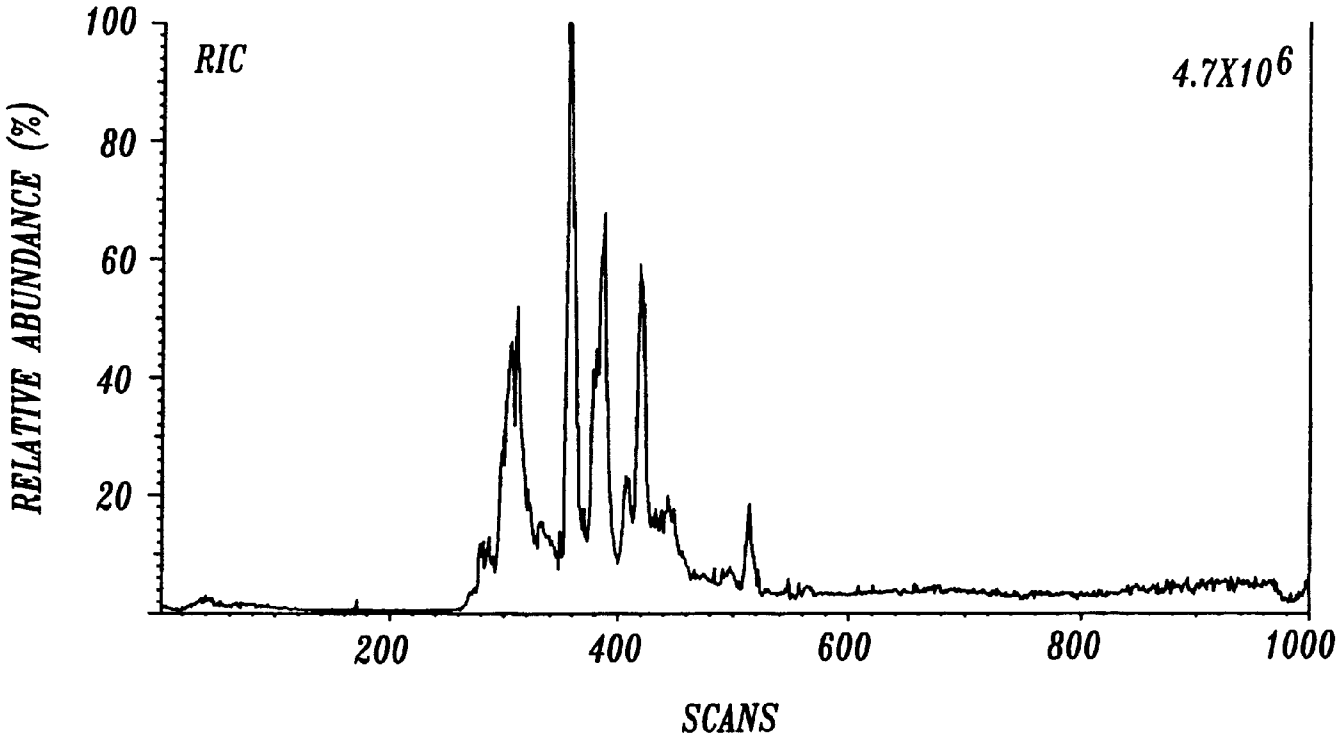
FIG. 12 is a reconstructed positive ion chromatogram for apomyoglobin tryptic digest introduced into a representative cylindrical capacitor ion source formed in accordance with the present invention with +2.0 kV applied to its central electrode and with an electron multiplier voltage of 1000 V.

The ion chromatograms obtained using the ES ion source and the ion source of this invention are shown in FIGS. 11 and 12, respectively. Make-up liquid was used with both systems in order to avoid a dilution S/N disadvantage for the ESI system. The addition of make-up liquid was also required for optimal signal stability in the ESI mode. With the ion source of this invention, the make-up liquid served primarily to inhibit occasional bubble formation at the spray tip, which is always a concern when carrying out LC experiments at such low flows where thorough mobile phase degassing is critical. The improved chromatography seen in FIG. 12 is probably a result of smaller extracolumn volume, about 80 nL, compared with above 340 nL for the ESI interface. The S/N ratios observed were roughly the same for both experiments suggesting that the ion source of this invention is suitable for positive ion capillary LC/MS applications.

Recombinant Human Factor XIII. Factor XIII b subunit, $M_r$ 83,136, a human blood coagulating factor, is known to contain various impurities in the storage buffer including glycine and EDTA. The Factor XIII b subunit protein was received at a concentration of about 100 pmol/$\mu$L in 10 mM glycine containing 10 mM EDTA. The stock solution was diluted 10:1 with a solution of 1% acetic acid in 1:1 acetonitrile/water and infused at a rate of 250 nL/min, scanning Q1, 2.0 sec/scan, centroid mode, from 600 to 2500 u, averaging 50 scans of data. The total solute concentration of the approximately 12 pmol/$\mu$L infusion solution was probably in excess of 10 mM. The positive ion mass spectrum of intact Factor XIII is shown in FIG. 13. The impurities present in the liquid sample were of quantity sufficient to coat the outside of the heated capillary with a salt crust after five minutes of infusion. After 20 minutes, loss of signal was complete. Signal was restored upon cleaning the heated capillary and the tube lens. Using an ESI source, it was not possible to generate a stable signal without adding a desalting step.

Example 7

Direct Comparison of Ion Sources

This example directly compares the performance of an optimized, commercially available ES ionization interface and a representative ion source of the present invention interfaced to the same mass spectrometer. In the comparison, bovine ubiquitin was infused at a rate of 50 nL/min. at a concentration of 500 fmol/$\mu$L in 1:1 acetonitrile/water 1% acetic acid, scanning from 1000 to 2500 m/z in 2.0 sec with the electron multiplier at 1000 V. To examine the independence of charging from solution pH in a representative ion source of the present invention, the comparative experiments were repeated without additional acetic acid using both interfaces at about pH4. The solutions were prepared by diluting a 10 pmol/$\mu$L stock solution (10% acetonitrile, 1% acetic acid v/v) by a factor of 20 with 1:1 acetonitrile/water. A negative ion spectrum was acquired using the same solution with a representative ion source of this invention.

Studies with clean, well defined solutions of horse apomyoglobin were also carried out using both an ESI interface and a representative ion source of this invention. A comparison of the data acquired under various solution conditions showed only one significant difference. While negative ions were generated from ubiquitin using the ion source of this invention, no negative ions were formed using an ES interface. Negative ions were generated from ubiquitin with the ion source of this invention at low pH (see FIG. 14), and similar results were also obtained for apomyoglobin infusion (200 nL/min in a standard positive ion calibration solution of 1% acetic acid (v/v) in 1:1 methanol/water at pH 3). For apomyoglobin, strong signals were unexpectedly observed for charge states ranging from −13 to −7 (see FIG. 16). No negative ions were observed for ubiquitin or apomyoglobin using ESI in the pH range of 3 to 4. Under all positive ion conditions tested, the two interfaces produced nearly identical results.

While the preferred embodiment of the invention has been illustrated and described, it will be appreciated that various changes can be made therein without departing from the spirit and scope of the invention.

What is claimed is:

1. A device for forming ions by induction ionization from a liquid sample containing a neutral polyatomic molecule, comprising an ion-forming capacitor having a pair of electrodes separated by a dielectric material, wherein the dielectric material has a $\epsilon_r \times S_r$ value greater than about $5\times10^8$, wherein $\epsilon_r$ is the dielectric constant of the dielectric material and $S_r$ is the dielectric strength of the dielectric material.

2. The device of claim 1 wherein the ion-forming capacitor is a cylindrical capacitor comprising a cylindrical electrode surrounding a central electrode, the cylindrical electrode separated from the central electrode by a dielectric material.

3. The device of claim 1 wherein the ion-forming capacitor is a parallel plate capacitor comprising a first electrode and a second electrode, wherein the first electrode is separated from the second electrode by a dielectric material.

4. The device of claim 1 wherein the dielectric material is selected from the group consisting of barium and strontium materials.

5. The device of claim 1 wherein the dielectric material is selected from the group consisting of barium titanate and strontium titanate.

6. The device of claim 1 wherein the dielectric material is a single crystalline barium titanate material.

7. The device of claim 1 wherein the dielectric material is glass doped with barium titanate.

8. The device of claim 1 wherein the dielectric material is fused silica doped with barium titanate.

9. A method for generating ions by induction ionization from a liquid sample containing a neutral polyatomic molecule, comprising the steps of:

(a) introducing the liquid sample into an ion source, wherein the ion source comprises a capacitor having a pair of electrodes separated by a dielectric material, wherein the dielectric material has a $\epsilon_r \times S_r$ value greater than about $5\times10^8$, wherein $\epsilon_r$ is the dielectric constant of the dielectric material and $S_r$ is the dielectric strength of the dielectric material; and (b) applying a voltage to the capacitor thereby forming ions from the polyatomic molecule.

10. The method of claim 9 wherein the dielectric material is selected from the group consisting of barium titanate and strontium titanate.

11. The method of claim 9 wherein the dielectric material is a single crystalline barium titanate material.

12. The method of claim 9 wherein the dielectric material is glass doped with barium titanate.

13. The method of claim 9 wherein the dielectric material is fused silica doped with barium titanate.

14. The method of claim 9 further comprising directing the ions to a mass analyzer for mass analysis.

15. A device for forming ions by induction ionization for mass spectral analysis from a liquid sample containing a neutral polyatomic molecule, comprising:

(a) an ion source for forming ions from the sample, the ion source comprising a capacitor having a pair of electrodes separated by a dielectric material, wherein the dielectric material has a $\epsilon_r \times S_r$ value greater than about $5\times10^8$, wherein $\epsilon_r$ is the dielectric constant of the dielectric material and $S_r$ is the dielectric strength of the dielectric material;

(b) a sample inlet for introducing the liquid sample to the ion source; and (c) an exit for directing the formed ions in the ion source to a mass analyzer for mass spectral analysis.

16. The device of claim 15 wherein the dielectric material is selected from the group consisting of barium titanate and strontium titanate.

17. The device of claim 15 wherein the dielectric material is a single crystalline barium titanate material.

18. The device of claim 15 wherein the dielectric material is glass doped with barium titanate.

19. The device of claim 15 wherein the dielectric material is fused silica doped with barium titanate.

20. The device of claim 15 further comprising a mass analyzer in fluid communication with the exit.

* * * * *

UNITED STATES PATENT AND TRADEMARK OFFICE

CERTIFICATE OF CORRECTION

PATENT NO. : 6,107,626
DATED : August 22, 2000
INVENTOR(S) : H. Wang, et. al.

It is certified that error appears in the above-identified patent and that said Letters Patent is hereby corrected as shown below:

| COLUMN | LINE | |
|---|---|---|
| [56] Pg. 1, col. 2 | Refs. Cited (Other Publs., Item 7) | "lab:" should read --Lab:-- |
| [56] Pg. 1, col. 2 | Refs. Cited (Other Publs., Item 7) | "Mass Spectrometry in the Biological Sciences," should read --*Mass Spectrometry in the Biological Sciences,*-- |
| 22 (Claim 9, | 48 line 11) | "capacitor thereby" should read --capacitor, thereby-- |

Signed and Sealed this

First Day of May, 2001

*Attest:*

Nicholas P. Godici

NICHOLAS P. GODICI

*Attesting Officer*

*Acting Director of the United States Patent and Trademark Office*